US006189911B1

(12) United States Patent
Caron et al.

(10) Patent No.: US 6,189,911 B1
(45) Date of Patent: Feb. 20, 2001

(54) SNOW BOARD BINDING SYSTEM

(75) Inventors: Jeffrey E. Caron, Tiverton; Geoffrey W. Smith, Portsmouth, both of RI (US)

(73) Assignee: Caron Alpine Technologies, Inc., Newport, RI (US)

( * ) Notice: Under 35 U.S.C. 154(b), the term of this patent shall be extended for 0 days.

(21) Appl. No.: 09/005,365

(22) Filed: Jan. 9, 1998

Related U.S. Application Data

(60) Provisional application No. 60/034,203, filed on Jan. 21, 1997, and provisional application No. 60/035,377, filed on Jan. 11, 1997.

(51) Int. Cl.[7] ..... A63C 9/00

(52) U.S. Cl. ..... 280/607; 280/618; 280/14.24

(58) Field of Search ..... 280/607, 617, 280/618, 633, 634, 623, 14.22–14.28, 625, 14.2, 14.21

(56) References Cited

U.S. PATENT DOCUMENTS

| | | | | |
|---|---|---|---|---|
| 4,652,007 | | 3/1987 | Dennis | 280/618 |
| 4,741,550 | | 5/1988 | Dennis | 280/618 |
| 4,856,808 | | 8/1989 | Lougoni | 280/617 |
| 5,028,068 | | 7/1991 | Donovan | 280/618 |
| 5,044,654 | | 9/1991 | Meyer | 280/613 |
| 5,044,656 | | 9/1991 | Peyre | 280/618 |
| 5,188,386 | | 2/1993 | Schweizer | 280/607 |
| 5,236,216 | | 8/1993 | Ratzek | 280/607 |
| 5,354,088 | | 10/1994 | Vetter et al. | 280/618 |
| 5,431,427 | * | 7/1995 | Pieber et al. | 280/607 |
| 5,474,321 | | 12/1995 | Pritz | 280/607 |

FOREIGN PATENT DOCUMENTS

| | | | |
|---|---|---|---|
| 678278 | 8/1991 | (CH) | A63C/9/02 |
| 684056 A5 | 7/1994 | (CH) | A63C/9/081 |
| 4209112 A1 | 3/1992 | (DE) | A63C/9/00 |
| 0432588A2 | 6/1991 | (EP) | A63C/9/08 |
| 2673546A1 | 9/1992 | (FR) | A63C/9/18 |
| 2702388 | 9/1994 | (FR) | A63C/9/18 |
| 2704439 | 11/1994 | (FR) | A63C/5/00 |
| WO 92/09339 | 6/1992 | (WO) | A63C/9/08 |
| WO 94/11071 | 5/1994 | (WO) | A63C/9/00 |
| WO 94/25125 | 11/1994 | (WO) | A63C/9/00 |

OTHER PUBLICATIONS

Fritshci—Brochure—Model'95 Diamond Face with Tilt Wedges.
Seabright Quick—Lock Brochure.
Checker Pig Catalog Model: '91 CPX Rotor.
Sportsystem Catalog Model: '94—'95—Zero TT.
Emery Catalog Model: '95—'93 Turbo Speedy.
Emery—Catalog Model 95—'96 course.
Fritchie Catalog Model: '95 Diamond Teeny.
Flytrap Catalog Model: Turntable.

* cited by examiner

*Primary Examiner*—Richard M. Camby
(74) *Attorney, Agent, or Firm*—Samuels, Gauthier & Stevens LLP

(57) ABSTRACT

A snowboard binding is shown for mounting a boot to a snowboard. The binding has adjustments for boot size and multiple degrees of freedom which results in many customizable adjustments. The binding is mounted so as not to dampen the flexure of the snowboard.

35 Claims, 15 Drawing Sheets

SNOW BOARD BINDING SYSTEM

CROSS REFERENCE TO PRIOR APPLICATIONS

This application claims the benefit of U.S. Provisional application No: 60/035,377 filed Jan. 11, 1997 and U.S. Provisional application No: 60/034,203 filed Jan. 21, 1997.

FIELD OF INVENTION

The invention relates to binding systems for securing footwear used to engage sliding devices such as in the Alpine sports of skiing, skiboarding and snowboarding. More specifically, the binding of this invention permits the sliding device to exhibit increased flexibility when in use.

BACKGROUND

Alpine sports such as skiing and snowboarding involve a board or set of boards for sliding on snow or, in some lesser preferred conditions, on ice; footwear for protecting the wearer's foot from the elements; and a means of securing the footwear to the board which is frequently called a binding. The boards themselves currently are commonly made of composite materials such as fiberglass, although previously wooden materials were popular. The binding which secures the footwear to the board(s) must meet several criteria with regard to safety and durability. The binding must secure the footwear to the board securely when in use, but must be easy to release should the wearer fall or wish to remove the board. Further, the binding when in use should prevent rather than cause damage to the board upon which it is mounted As Alpine sports enthusiasts push the limits of performance set by past enthusiasts, the need for high performance bindings has increased. When enthusiasts move to rough terrain with moguls and potholes, increased potential exists for shock and stress to be applied to the board, the boot and the bindings, as well as to the enthusiast himself or herself. This can result in damage to the board, premature release of the boot, and damage to the joints of the skier. Thus, it is desirable to diffuse and spread the shock over a larger area to prevent damage to the board and the enthusiast.

Further, Alpine enthusiasts are demanding greater ability to adjust the elevation, tilt and angle of their board(s) with respect to the plane of the sole of their foot, to allow for higher performance and greater variety of movement. Previous methods and bindings have addressed tilt or angle or performance. However, none have provided the degree of flexibility and adjustability combined with ease of manufacture achieved by the instant invention.

SUMMARY

The binding for mounting footwear onto alpine equipment such as for example alpine skis, mono-skis, short skis or skiboards and snowboards, comprising means for minimizing the flat spots on the sliding device and binding system for mounting the footwear on the sliding device. In a first embodiment, the binding comprises an elastomer layer and a binding system for mounting the foot wear on the sliding device. In a second embodiment, the binding comprises a main binding plate having a central sliding device contact zone which is at least about 1/12 of the length of the main binding plate and a mounting means for attaching footwear onto the sliding device. In a third embodiment, the binding comprises a means for adjusting the heel mounting block and a toe mounting block comprising a slot and a fastener, at least one frictionlized zone proximal to the slot, a means for mounting footwear onto a sliding device and a retaining layer. In a fourth embodiment, the binding device comprises an elastomer layer, a system for tilt and angle adjustment and a binding system for mounting footwear onto the sliding device. In a fifth embodiment, the binding is comprised of a shock absorbing layer comprised of an elastomer having a durometer in the approximate range of 50 to 90 located substantially parallel to the upper plane of the sliding device and a binding system having a main binding plate having at least one frictionalized zone and at least one elongated slot, a toe mounting block, and a heel mounting block. In a sixth embodiment, the invention further includes a system to adjust the tilt or elevation of the binding system relative to the upper plane of the board. In a seventh embodiment, the invention comprises a shock absorbing layer as above, means for rotating the binding system into and out of the plane defined by the upper surface of the sliding device, and a binding system comprising a main binding plate having at least one frictionalized zone and at least one elongated slot, a toe mounting block and a heel mounting block where, preferably, the heel bail is non-rotatable in the heel mounting block. In an eighth embodiment, the invention of the seventh embodiment further includes a system to fixedly adjust the angle of elevation of the binding relative to the upper plane of the sliding device. Variations on each embodiment are also described.

In the preferred embodiments shown herein, the binding system comprises a main binding plate having at least one frictionalized zone and at least one closed slot at an end of the elongated main binding plate, a locked heel bail system (also called a non-rotating heel bail system), and a rotatable toe bail system. The toe bail system has a lever mechanism for locking the toe of the footwear into position, a toe bail mounting, a toe bail and at least one rotatable axis. The toe bail system is located at the proximal end of the main binding plate over the central slot in the main binding plate at that end. It has a toe bail which has coined bail ends for securing the bail to the lever. The lever is rotatably mounted on the toe bail mounting at an axis. The heel bail system is comprised of a heel bail and a heel bail mounting. The heel bail system is located at the distal end of the main binding plate. The heel bail mounting is centered over the central closed ended slot at that end. The heel bail has bail ends which are shaped to prevent detachment and which are fixed by compression into bail pockets in the heel bail mounting. Each of the toe bail system and the heel bail system bail mounting are adjustably mounted on the main binding plate at their respective slots by a fastener which allows adjustment of each bail mounting at its appropriate end of the main bail plate by loosening of the fastener, then sliding the fastener in conjunction with the appropriate bail system either towards or away from the center of the elongated main binding plate, and finally tightening the bail system into the desired position. Each fastener extends from its respective bail mounting through a slot in the main bail plate. In the preferred embodiment, the slot is closed at each end to prevent the loosened bail system from becoming detached from the main binding plate.

When the binding system is attached to a sliding device such as an Alpine ski, a shock absorbing layer, preferably made from an elastomer, is sized to fit at least the middle one third section of the main binding plate. The shock absorbing layer has a durometer in the range of 50 to 90 and is placed between the upper planer surface and the lower surface of the main binding plate. Further, the shock absorbing layer is sized to accommodate tilting of the binding system such that at all angles of tilt, the edges of the main binding plate interact with the shock absorbing layer. When the sliding device is a short ski or skiboard, the shock absorbing layer may be notched at each end in a position which would correspond to the closed ended slots at each of the proximal and distal ends of the main binding plate when the shock absorbing layer is mounted between the lower surface of the main binding plate and the upper surface of the ski. The open-ended slots allow the slidable fastener to clear the binding slot of snow.

When the binding system is attached to a sliding device such as a snow board, a disk shaped retaining layer may be mounted between the main binding plate and the shock absorbing layer. The retaining layer preferably is disc-like in shape. The upper surface of the disc, upon which the lower surface of the main binding plate is mounted, is substantially flat creating a flat region. This area is surrounded by an annular zone which may be frictionalized to reduce rotation of the main binding plate on the retaining layer when the main binding plate is mounted thereon by binding plate mounting screws. In the most preferred embodiment outside of and surrounding the annular zone is a chamfered region or edge. The flat region of the retaining layer has a central aperture, a plurality of apertures for receiving board mounting screws, and a plurality of D-shaped apertures surrounding the apertures for receiving board mounting screws. A threaded nut having flattened bottom, a rounded top surface and two flattened side surfaces is mounted in the central aperture, slightly protruding therefrom. When the main binding plate is appropriately mated to the retaining layer by mounting screws, rotation on the threaded nut provides for tiltability of the binding system relative to the sliding device. Elevation of the binding from the retaining layer may be regulated at the main binding plate mounting screws by use of washers and button head screws which are used in place of flat headed main binding plate screws.

DESCRIPTION OF THE PHOTOGRAPHS

The following photographs reflect many of the embodiments discussed in this application.

Photograph 1 is a disassembled view of a binding.

Photographs 2, 3, and 4 show a spherical nut.

Photographs 5 and 6 show a toe bail.

Photographs 7 and 8 show a lever.

Photographs 9 and 10 show a retaining layer with associated fasteners.

Photograph 11 and 12 show a tilt platform, top view and underside view, respectively.

Photograph 13 shows an embodiment for a heel bail and a heel block not cited in the text.

Photograph 14 shows a toe subassembly and associated hardware.

Photographs 15 and 16 show a close up of a tilting system with a resilient layer.

Photograph 17 shows a nearly assembled binding.

Photograph 18 shows a resilient layer.

Photograph 19 shows a tilt platform underside with tilt supports.

Photograph 20 shows a toe assembly and a heel assembly with associated fasteners.

Photograph 21 shows an underside view of a nearly complete binding.

Photograph 22 shows a boot in a binding.

Photographs 23 and 24 show a complete binding from different perspectives.

DESCRIPTION OF INVENTION

Overview

Figure 2:
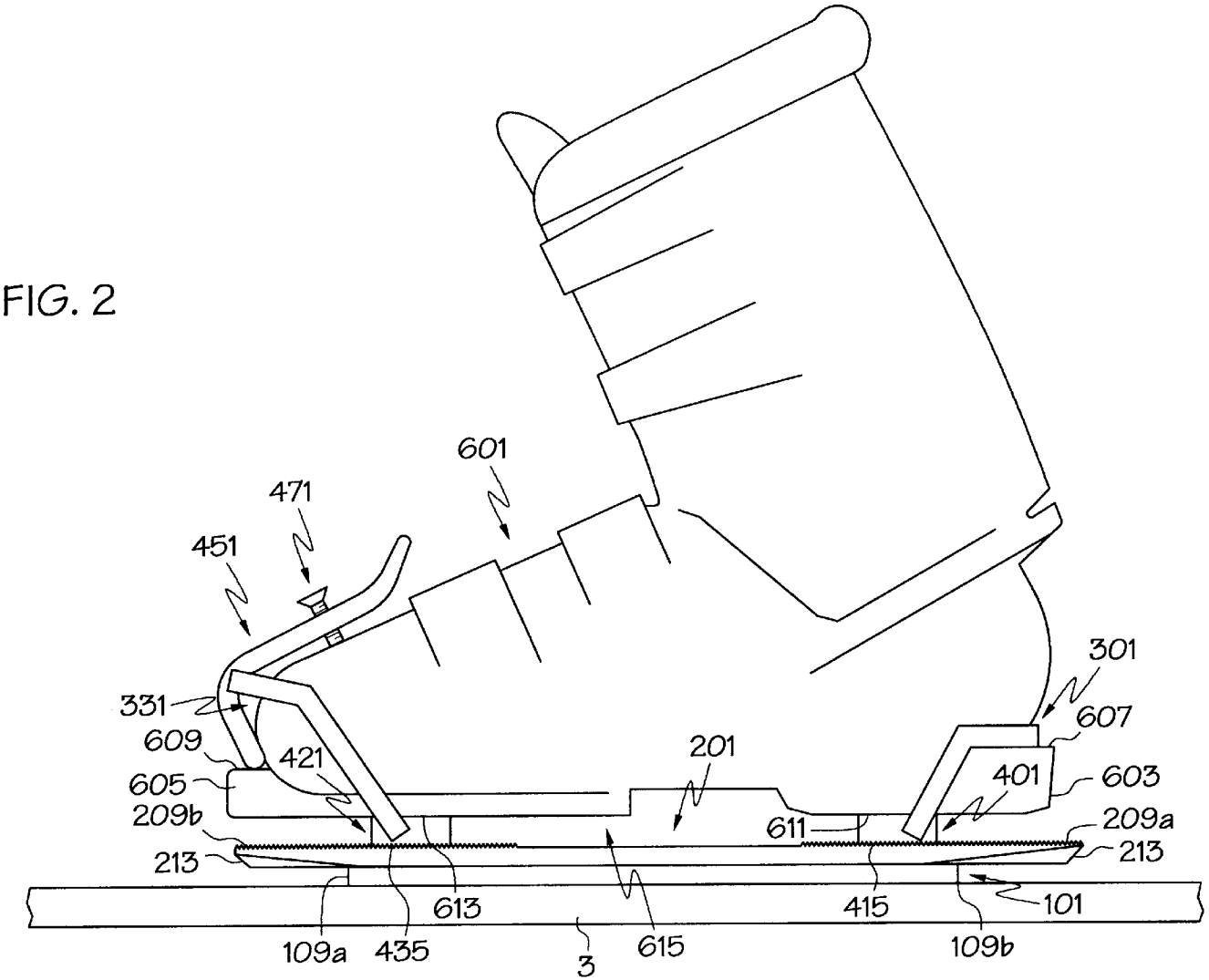
FIG. 2 shows a side view of a boot joined to first embodiment binding which is joined to a ski sliding device.

Embodiments for a binding which retains a sliding device 1 to a boot 601 are given, FIG. 2. A first binding embodiment retains a boot 601 to a ski sliding device 3. A ski sliding device or skiboard 3 is generally a short version of a traditional ski, usually under 120 cm in length. A ski sliding device 3 is highly maneuverable, lightweight, and provides the user with a sensation analogous to that experienced from in-line skates and skiing. A second binding embodiment retains boot 601 to a snowboard sliding device 5, see FIG. 10. A snowboard sliding device 5 is characterized by the affixation of both of the user's feet, generally one in front of the other, to a single snowboard sliding device 5.

Generally a sliding device 1 comprises sliding device mounting holes 7 which facilitate affixation of a binding to it. Similarly a boot 601 generally has a boot sole 615 which facilitates it's affixation to a binding.

First Embodiment

General

Figure 1:
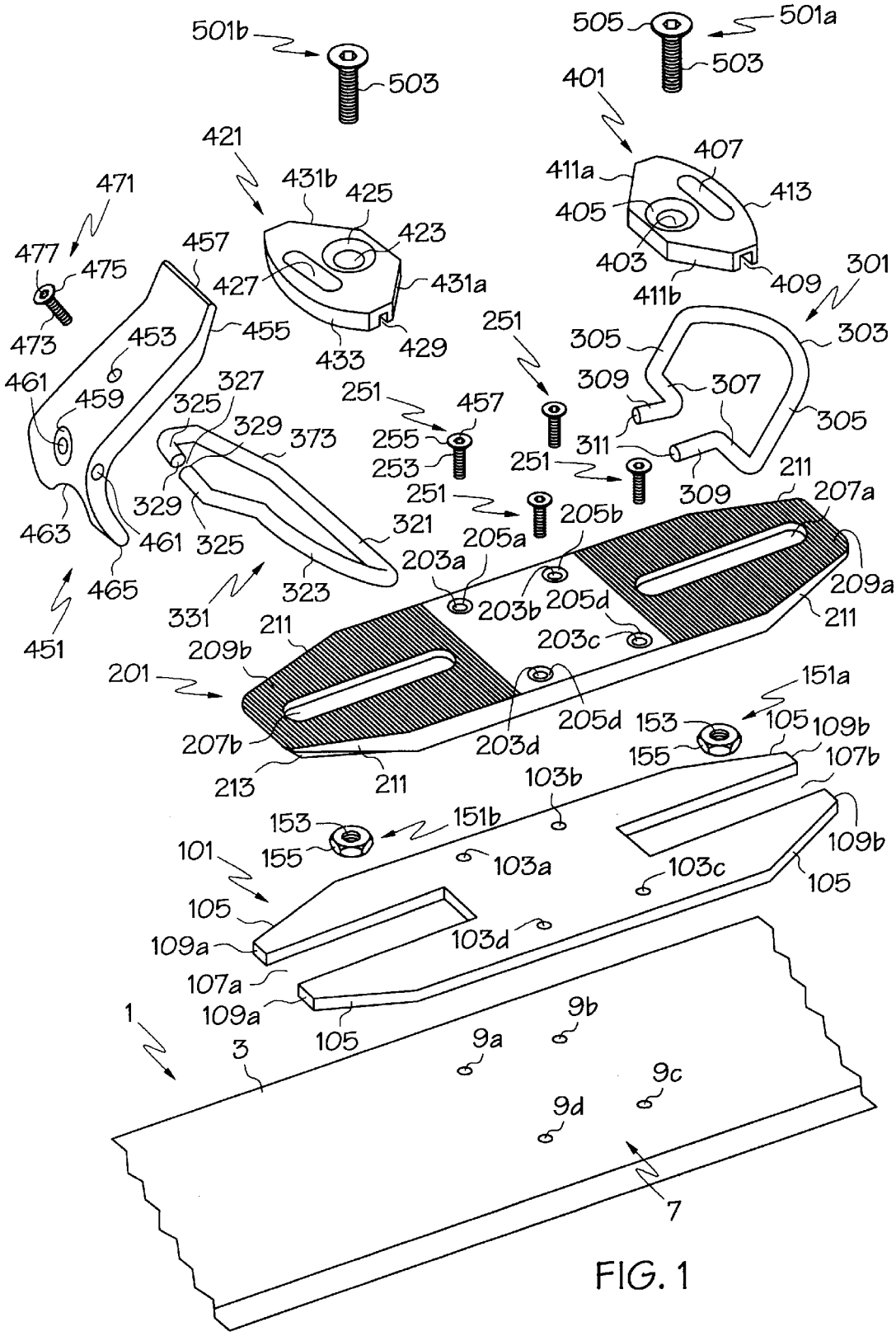
FIG. 1 shows a first embodiment exploded view of a binding and a ski sliding device.

FIG. 1 shows a ski sliding device 3 comprising four ski sliding device mounting holes 9*a*, 9*b*, 9*c*, 9*d*. Ski sliding device mounting holes 9*a*, 9*b*, 9*c*, 9*d* often contain 6 mm diameter ×1 mm pitch stainless steel threaded inserts of the type commonly used in the snowboard industry. While four ski sliding device mounting holes 9*a*, 9*b*, 9*c*, 9*d* are depicted in FIG. 1 and are the preferred number, fewer or more mounting holes will suffice.

As shown in FIGS. 1 and 2, a platform 201 mounts to ski sliding device 3. A resilient layer 101 rests between ski sliding device 3 and platform 201. A fixed heel block 401 is joined to platform 201 and holds secure a first fixed heel bail 301 which in turn holds secure a boot heel lip 607. Similarly, a rotary block 421 is joined to platform 201 and holds secure a toe bail 331. A lever 451 is also attached to toe bail 331 and is used to secure boot toe lip 609.

Figure 7:
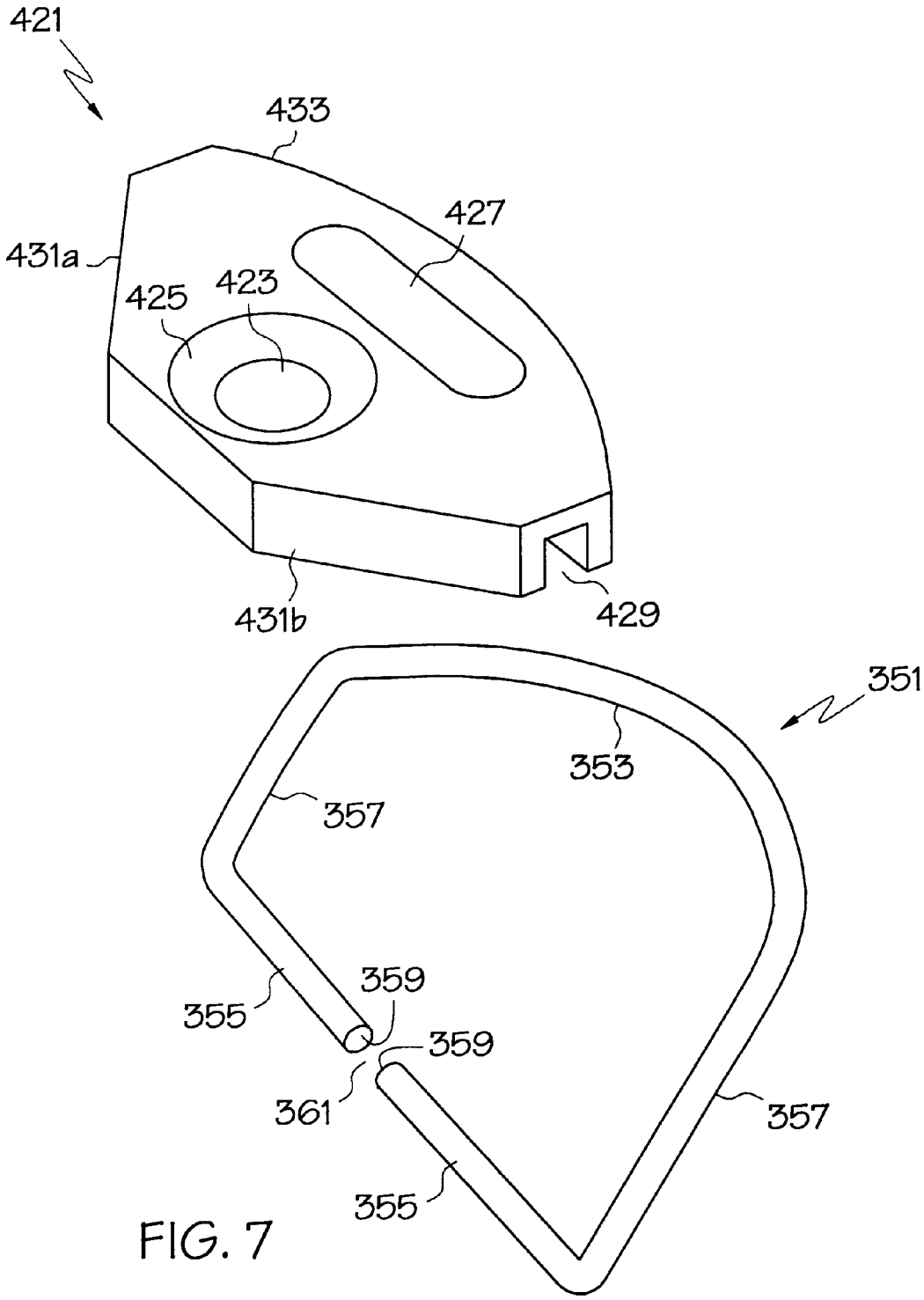
FIG. 7 shows a rotary heel bail and a rotary heel block.
Figure 8:
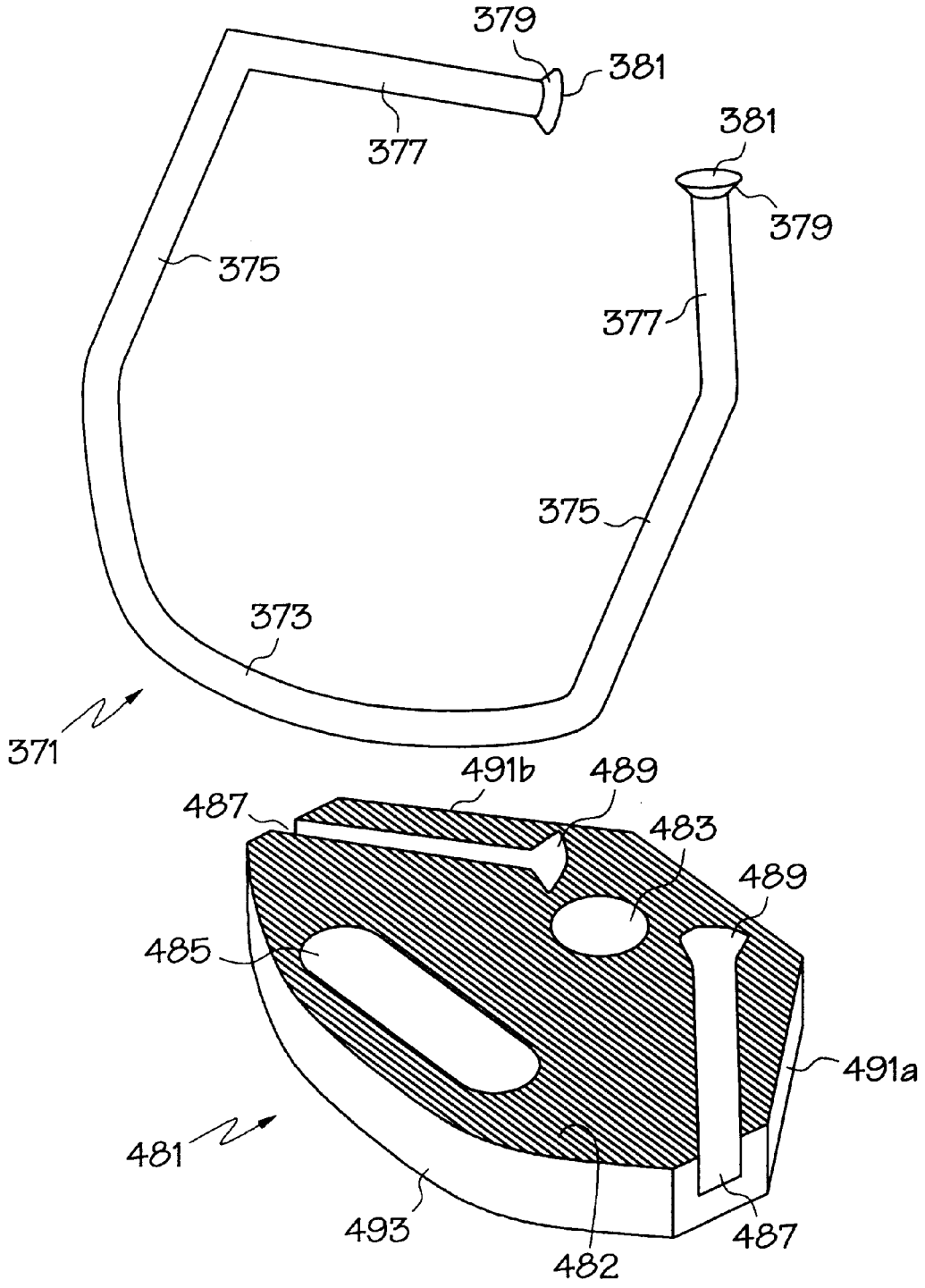
FIG. 8 shows a fixed heel bail and a fixed heel block second embodiment.

In the first embodiment, lever 451 is used to clamp boot toe lip 609 and a heel bail, specifically referred to as a first fixed heel bail 301, a rotary heel bail 351, FIG. 7, or a second fixed heel bail 371, FIG. 8, is used to clamp boot heel lip 607. It should be noted that with slight modifications lever 451 could be used to clamp boot heel lip 607. Similarly, with slight modification first fixed heel bail 301, rotary heel bail 351, or second fixed heel bail 371 could be used to clamp boot toe lip 609.

Resilient layer

As shown in FIGS. 1 and 2, resilient layer 101 rests between sliding device 3 and platform 201. Resilient layer 101 has resilient layer screw holes 103*a*, 103*b*, 103*c*, 103*d* positioned to match the position of ski sliding device mounting holes 9*a*, 9*b*, 9*c*, 9*d*. Resilient layer 101 also comprises a resilient layer taper 105 and two resilient layer notches 107*a*, 107*b*. Resilient layer notches 107*a*, 107*b* are sized to allow any necessary clearance for a size adjustment nut 151*a*, 151*b*. Additionally the open end of resilient layer notches 107*a*, 107*b* allow for easy removal of accumulated snow. The extent or length of resilient layer 101 is determined by the position of a resilient layer ends 109*a* and 109*b*. FIG. 2 clearly depicts resilient layer ends 109*a* and 109*b* extending less than the extent of platform 201. While the extent of resilient layer ends 109 can vary, in the preferred embodiment they extend from one third to the full length of platform 201. Resilient layer 101 exhibits the properties of an elastomer with a durometer in the range from 50 to 90. However, the composition of resilient layer 101 is not limited to elastomers. In the preferred embodiment, resilient layer 1 has thickness ranging from 3 millimeters to 10 millimeters. The amount of resilience could vary with position in the layer, thereby allowing for varying compressibility in different locations. Resilient layer 101 is not limited to the perimeter shape as set forth in FIG. 1. The effective compressibility along the longitudinal axis of resilient layer 101 can be controlled by the orientation and size of resilient layer taper 105.

Platform

Figure 3:
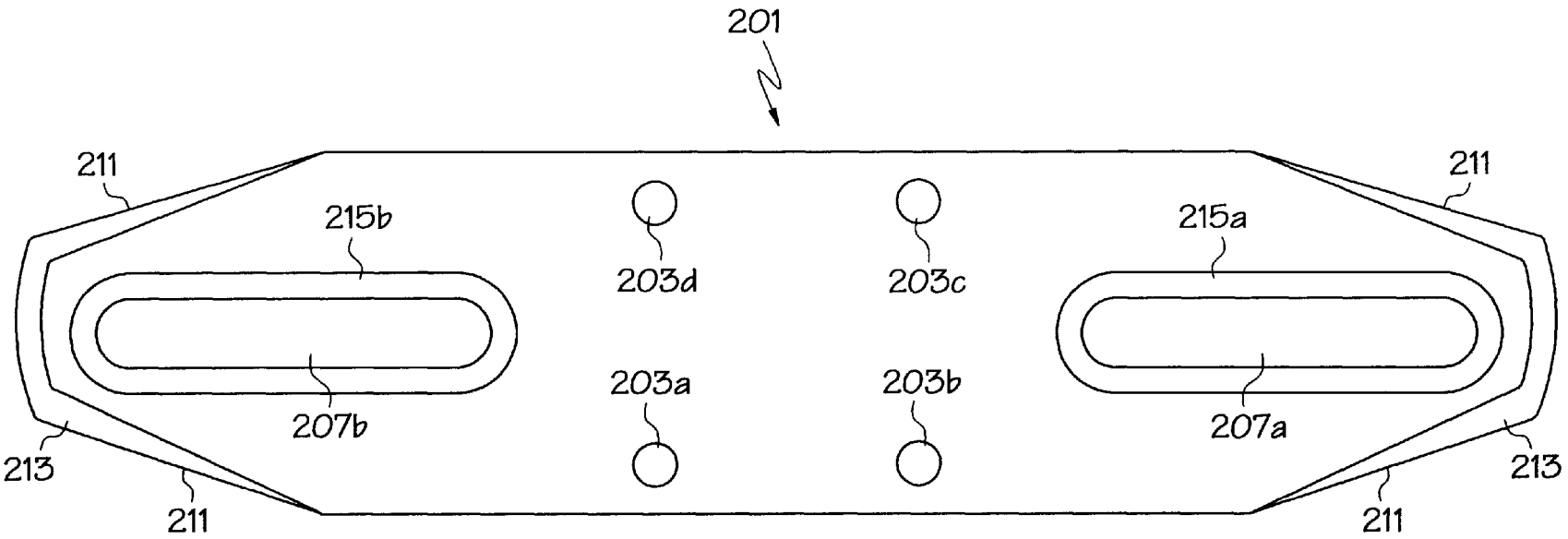
FIG. 3 shows an underside view of a first embodiment platform.

As shown in FIGS. 1, 2, and 3 platform 201 has four platform screw holes 203*a*, 203*b*, 203*c*, 203*d*. Each platform screw hole is positioned to align with resilient layer screw holes 103*a*, 103*b*, 103*c*, 103*d* and ski sliding device mounting holes 9*a*, 9*b*, 9*c*, 9*d*. Each platform screw hole 203 has a platform screw hole counter bore 205*a*, 205*b*, 205*c*, 205*d*. Platform 201 has a platform slot 207*a*, 207*b* and a respective platform counter slot 215*a*, 215*b* on the side opposite platform screw hole counter bores 205*a*, 205*b*, 205*c*, 205*d*. Platform 201 has a platform frictionalized surface 209*a*, 209*b* in the form of grooves or teeth which are perpendicular to platform slot 207*a*, 207*b*. Platform 201 has a platform taper 211 and a platform chamfer 213.

Platform screw holes 203*a*, 203*b*, 203*c*, 203*d* are centrally located in platform 201. The central location is generally defined as the central sixty percent of the length of platform 201 located at it's midpoint. Four platform screw holes 203*a*, 203*b*, 203*c*, 203*d* centrally located in platform 201 offer a high performance, durable, and cost effective means to secure platform 201 to ski sliding device 3. In the preferred embodiment, platform screw holes 203 are located at the corners of a rectangle ranging in dimensions from 40 mm×40 mm to 120 mm×60 mm.

In the preferred embodiment platform 201 is constructed from 7075-T6 aluminum. This material offers a sufficient strength at an acceptable weight. In the preferred embodiment the overall dimensions of aluminum platform 201 range from 180 mm long×45 mm wide×6.3 mm thick to 270 mm long×80 mm wide×12.7 mm thick. Optimum platform dimensions for aluminum construction are approximately 240 mm long×55 mm wide×8 mm thick. This size accommodates most boot sizes, provides adequate stiffness in it's longitudinal direction, and is lightweight. Other aluminum alloys may be used to fabricate platform 201. Processes to shape platform 201 from aluminum include but are not limited to machining, extrusion, molding, casting, or a combination thereof.

In a second embodiment platform 201 is fabricated from other high performance materials such as thermoplastics, reinforced thermoplastics, carbon fiber, kevlar, and titanium. If these materials are used the optimum dimensions of platform 201 will vary from those of aluminum.

One platform slot 207*a*, 207*b* is located on each end of platform 201. Reasonable minimum and maximum dimensions of platform slot 207*a,b* range from 8 mm wide×30 mm long to 10 mm wide×70 mm long. The length of slots 207*a,b* is determined by the range of boot sizes that must be accommodated. The optimum length of slots 207*a,b* has been determined to be from 45 mm to 65 mm long. The width of slot 207*a,b* is determined by the diameter of size adjustment screws 501*a,b* chosen. 8 mm to 10 mm are optimal for the forces at hand.

Alternatively two parallel, side by side, narrow slots (not shown) could replace the single platform slot 207*a*, 207*b*. This has the advantage of using less costly fasteners which are say 6 mm in diameter. However two disadvantages include the increased cost to fabricate the second slot and the increased complexity for the user.

Counter slot 215*a*, 215*b* is sized to prevent size adjustment nut 151*a*, 151*b* from turning when tightening a size adjustment screw 501*a*, 501*b*. Counter slot 215*a,b* is also sized to allow size adjustment nut 151*a*, 151*b* to be substantially recessed into platform 201.

Figure 9A:
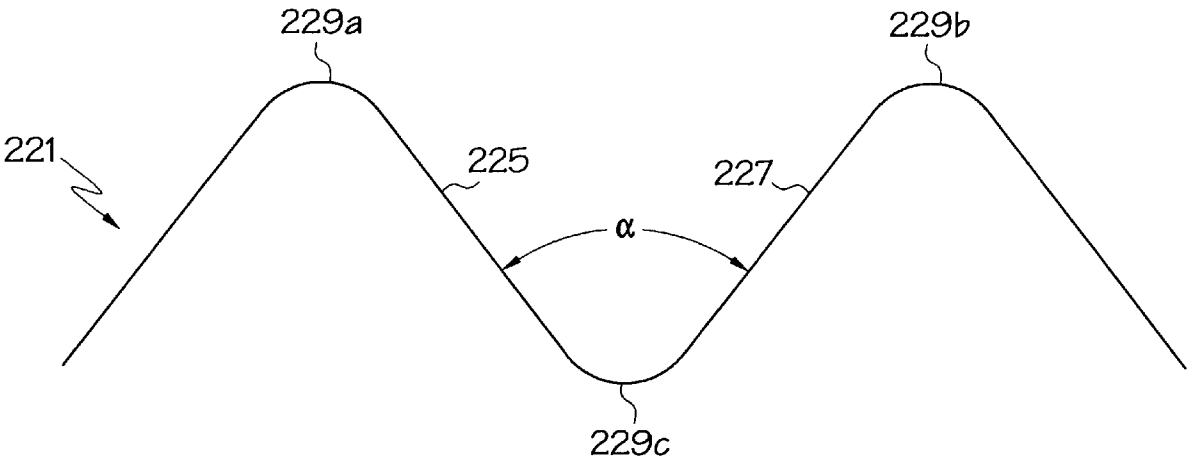
FIG. 9*a* shows a first cross section view of a groove or a tooth.
Figure 9B:
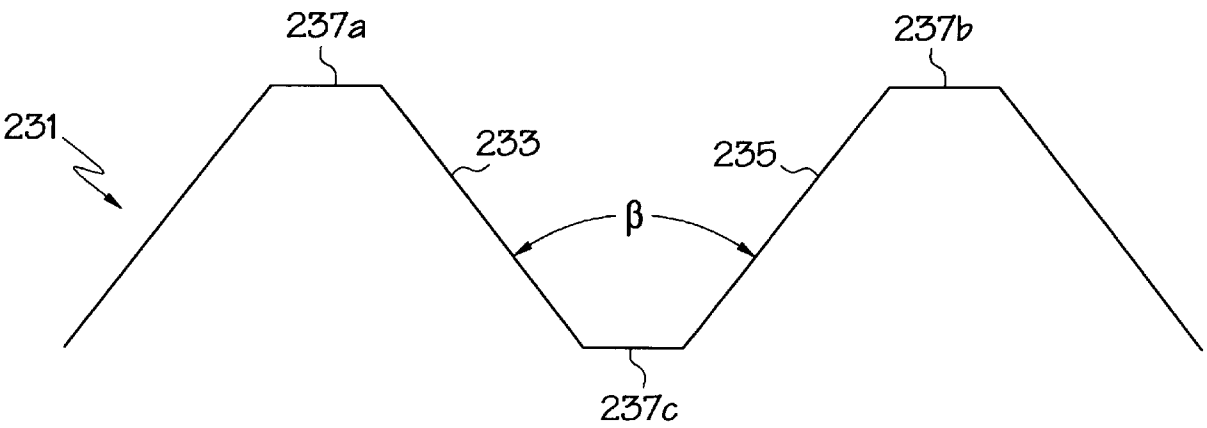
FIG. 9*b* shows a second cross section view of a groove or a tooth.

In the preferred embodiment platform frictionalized surface 209*a,b* is implemented by a tooth or groove 221. FIG. 9*a* shows a cross sectional view of groove 221. Groove 221 is approximately perpendicular to platform slot 207*a*, 207*b*. Groove 221 is comprised of at least one sloped plane 225 and at least one adjacent sloped plane 227 whose slope is approximately equal and opposite to that of sloped plane 225. Sloped plane 225 and adjacent sloped plane 227 are joined by a curved profile section 229*a*, 229*b*, 229*c*. Curved profile section 229*a*, 229*b*, 229*c* may be a natural occurrence in the scenario where the groves are molded, cast, or extruded. Groove spacing, defined as the linear distance from the peak of curved profile section 229*a* to the peak of curved profile section 229*b* is typically a minimum of 1 mm and a maximum of 4 mm. The optimum range is 1 mm to 2 mm. Groove depth, defined as the projected vertical distance from curved profile section 229*a* to curved profile section 229*c*, is typically 0.25 mm to 1.5 mm. The angle alpha typically ranges from 50 degrees to 120 degrees. Optimum angles for alpha generally are between 55 degrees and 95 degrees. FIG. 9*b* depicts a modified groove 231 which is essentially the same as groove 221, with the exception that curved profile section 229*a*, 229*b*, 229*c* is replaced by a linear profile section 237*a*, 237*b*, 237*c*. It should be noted that a superposition of planes may in fact replace sloped plane 225 and adjacent sloped plane 227, thereby replacing the linear slope profile with an essentially curved profile. For most practical purposes this is a functional equivalent.

Platform frictionalized surface 209*a*, 209*b* typically exists on opposite ends of a upward face of platform 201. An extent of the frictionalized surface from an end of platform 201 toward it's center is determined by the need to accommodate a small boot 601. Typically platform frictionalized surface 209*a*, 209*b* will cover the entire upward facing surface of platform 201 with the exception of the central 25 to 35 percent.

First Fixed Heel Bail and First Fixed Heel Block—Assembly

A first fixed heel bail 301 has a first fixed heel bail rounded section 303 as shown in FIG. 1. A first fixed heel bail sloped section 305 forms a plane different than that formed by first fixed heel bail rounded section 303. A first fixed heel bail first securing section 307 and a first fixed heel bail second securing section 309 lie in a plane approximately parallel to the plane formed by first fixed heel bail rounded section 303. Two first fixed heel bail ends 311 terminate the part. Possible materials to manufacture first fixed heel bail 301 include stainless steel, spring hardened stainless steel, titanium, and steel. The material of preference is stainless steel. If stainless steel is used in a non-hardened form, an optimum wire diameter range is approximately 6 mm to 8 mm. Such bails are considered wireforms and are made in four-slide machines.

Figure 4:
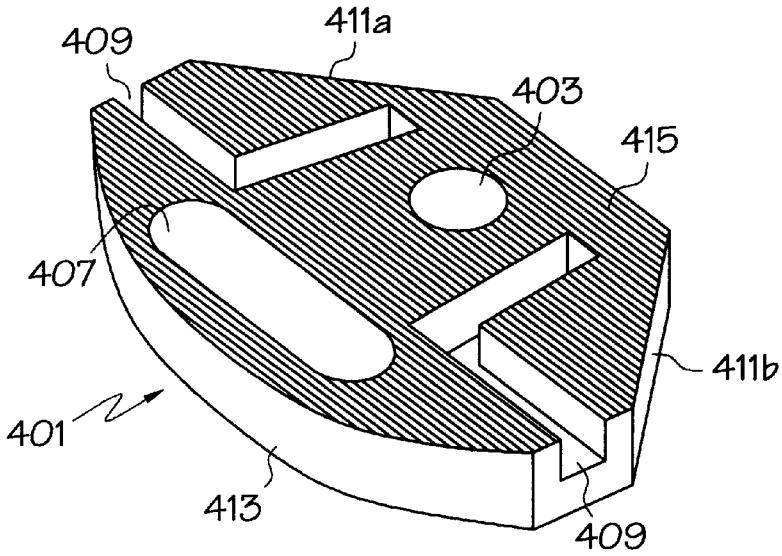
FIG. 4 shows an underside view of a fixed heel block first embodiment.

As shown in FIGS. 1 and 4, a first fixed heel block 401 has a first fixed heel block bore 403 and a first fixed heel block counter bore 405. First fixed heel block 401 has a first fixed heel block hollow 407. A first fixed heel block cavity 409 is shaped to mate with first fixed heel bail first securing section 307 and first fixed heel bail second securing section 309. Upon assembly with first fixed heel bail first securing section 307 and first fixed heel bail second securing section 309 are placed into first fixed heel block cavity 409. First fixed heel block 401 has a perimeter shape comprised of two first fixed heel block angled sections 411*a,b* and a first fixed heel block curved section 413. First fixed heel block 401 has a first fixed heel block frictionalized surface 415 in the form of grooves or teeth which are sized to engage platform frictionalized surface 209*a*. First fixed heel block frictionalized surface 415 prescribes to the definitions as portrayed by FIGS. 9*a* and 9*b* and the associated text pertaining to these figures. Materials to manufacture first fixed heel block 401 include, but are not limited to, aluminum, thermoplastics, reinforced thermoplastics, carbon fiber, kevlar, and titanium.

Toe Bail, Rotary Block, Lever, and Lever Screw—Assembly

As shown in FIG. 1, 2, 5, and 6 toe bail 331 has a first axle section 321 connected to a toe bail radius section 323. Toe bail radius section 323 joins a toe bail second axle section 325. A toe bail gap 327 separates two toe bail ends 329. In final assembly toe bail ends 333 are cold formed creating a toe bail coined end 333. Possible materials to manufacture toe bail 331 include stainless steel, spring hardened stainless steel, titanium, and steel. The material of preference is stainless steel. If stainless steel is used in a non-hardened form, an optimum wire diameter range is approximately 6 mm to 8 mm. Such bails are considered wireforms and are made in four-slide machines.

Figure 5:
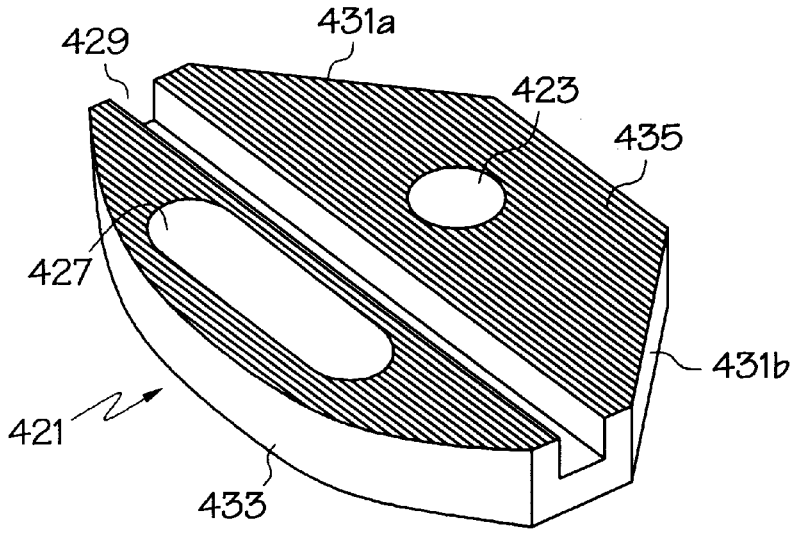
FIG. 5 shows an underside view of a rotary block.

As shown in FIG. 1, a rotary block 421 has a rotary block bore 423 and a rotary block counter bore 425. Rotary block 421 also has a rotary block hollow 427. A rotary block cavity 429 is also provided in the form of a channel, FIG. 5. Upon assembly, first axle section 321 is placed within rotary block cavity 429, which is shown in FIG. 5. Rotary block 421 has a perimeter shape comprised of two rotary block angled sections 431*a* & 431*b* and a rotary block curved section 433. Rotary block 421 has a rotary block frictionalized surface 435 in the form of grooves or teeth which are sized to engage platform frictionalized surface 209*b*. Rotary block frictionalized surface 435 prescribes to the definitions as portrayed by FIGS. 9*a* and 9*b* and the associated text pertaining to these figures. Materials to manufacture rotary block frictionalized surface 435 include, but are not limited to, aluminum, thermoplastics, reinforced thermoplastics, carbon fiber, kevlar, and titanium.

Figure 6:
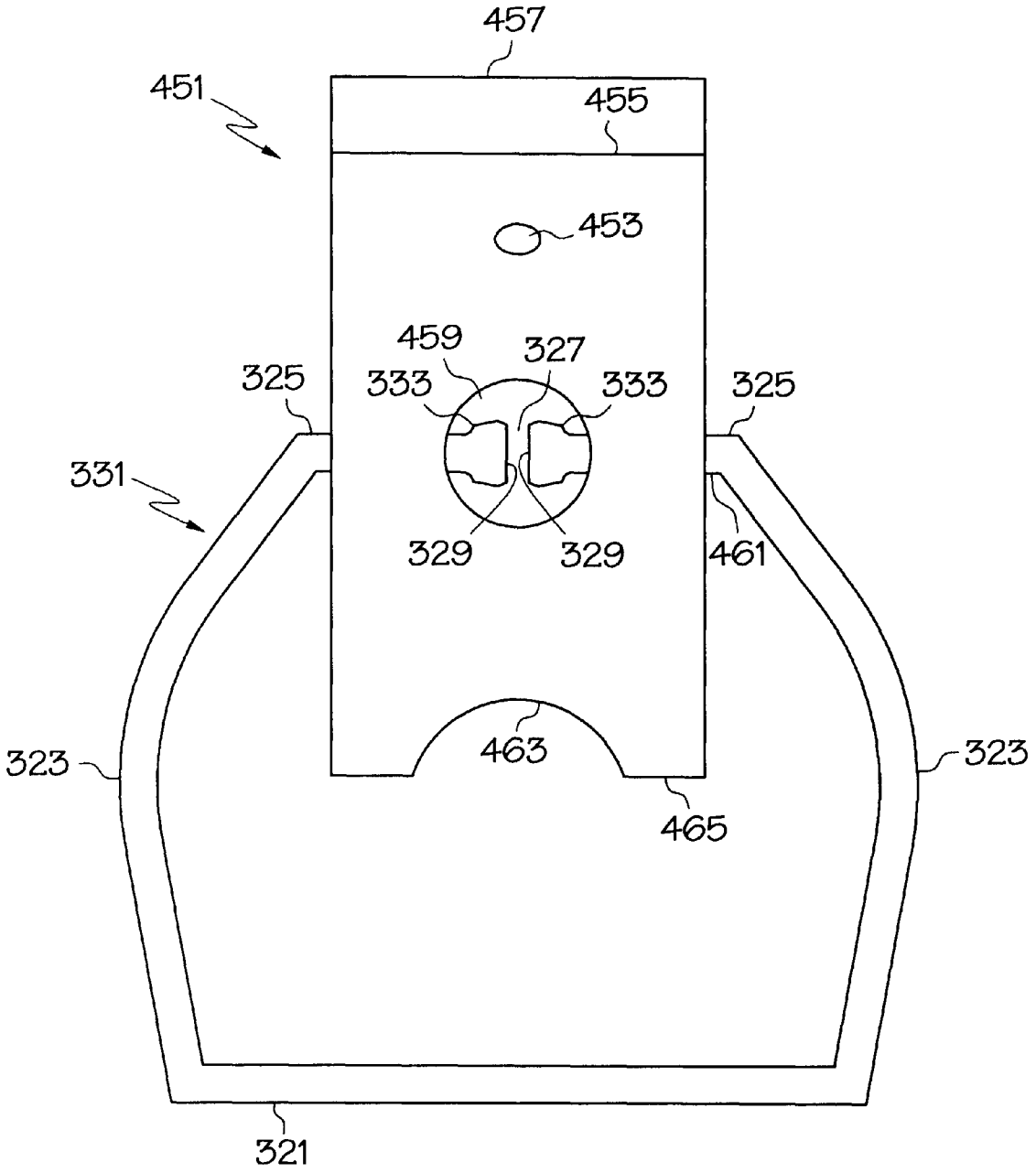
FIG. 6 shows a lever and a toe bail in assembled form.

As shown in FIG. 1 and 6, a lever 451 has a lever axial hole 461. Toe bail second axle sections 325 coexists after assembly in lever axial hole 461. One end of lever 451 has a lever scallop 463 finished with a lever second rounded end 465. The opposite end has a lever finger tab 455 finished with a lever first rounded end 457. A lever adjustment screw hole 453 is located between lever finger tab 455 and lever axial hole 461. A lever coining hole 459 bisects lever axial hole 461. Toe bail coined ends 333 lie in the aperture created by lever coining hole 459. To assemble toe bail 331 to lever 451, one places toe bail second axle section 325 into lever axial hole 461. This requires slightly deforming toe bail 331. Then a die and hydraulic press are used to flatten toe bail ends 329, thereby creating toe bail coined ends 333, best seen in FIG. 6.

A lever adjustment screw 471 has a lever adjustment screw thread 473 sized to mate with lever adjustment screw hole 453. Lever adjustment screw 471 also has a lever adjustment screw head 475 and a lever adjustment screw tool interface 477. The preferred material for lever adjustment screw 471 is stainless steel. A reasonable size is 8 mm by 25 mm. The lever adjustment screw is turned into and out of lever 451.

Second Fixed Heel Bail and Second Fixed Heel Block—Assembly

As shown in FIG. 8, a second fixed heel bail 371 has an alternate fixed heel bail rounded section 373 is joined to an alternate fixed heel bail sloped section 375. Alternate fixed heel bail sloped section 375 joins an alternate fixed heel bail securing section 377. Alternate fixed heel bail securing section 377 has two alternate fixed heel bail ends 381. Alternate fixed heel bail ends 381 each have an alternate fixed heel bail coin 379. Possible materials to manufacture second fixed heel bail 371 include stainless steel, spring hardened stainless steel, titanium, and steel. The material of preference is stainless steel. If stainless steel is used in a non-hardened form, an optimum wire diameter range is approximately 6 mm to 8 mm. Such bails are considered wireforms and are made in four-slide machines.

Also shown in FIG. 8 is a second fixed heel block 481 having a second fixed heel block bore 483 and an second fixed heel block hollow 485. A second fixed heel block cavity 487 is sized to accommodate second fixed heel bail securing section 377. Second fixed heel block cavity 487 is joined to a second fixed heel block coin cavity 489. Upon assembly fixed heel bail securing section 377 is placed into second fixed heel block cavity 487. The second fixed heel block 481 has a frictionalized surface 482 in the form of grooves or teeth which are sized to engage platform frictionalized surface 209*b*. The second fixed heel block frictionalized surface 482 prescribes to the definitions as portrayed by FIGS. 9*a* and 9*b* and the associated text pertaining to these figures. Materials to manufacture second fixed heel block 481 include, but are not limited to, aluminum, thermoplastics, reinforced thermoplastics, carbon fiber, kevlar, and titanium.

Rotary Heel Bail—Assembly

As shown in FIG. 7 a rotary heel bail 351 has a rotary heel bail rounded section 353. Rotary heel bail rounded section 353 is joined to a rotary heel bail sloped section 357. Rotary heel bail sloped section 357 is joined to a rotary heel bail axial section 355. Rotary heel bail axial section 355 has in its approximate center two rotary heel bail ends 359. Rotary heel bail ends 359 are separated by a rotary heel bail gap 361. Possible materials to manufacture rotary heel bail 351 include stainless steel, spring hardened stainless steel, titanium, and steel. The material of preference is stainless steel. If stainless steel is used in a non-hardened form, an optimum wire diameter range is approximately 6 mm to 8 mm. Such bails are considered wireforms and are made in four-slide machines. When assembled, rotary heel bail axial section 355 is placed inside rotary block cavity 429.

Other Fasteners

A size adjustment screw 501*a*, 501*b*, FIG. 1, has a size adjustment screw thread 503 which mates with size adjustment nut thread 153. A size adjustment screw head 505 has a size adjustment screw tool interface 507. A size adjustment nut 151*a*, 151*b* has a size adjustment nut thread 153. Size adjustment nut 151*a*, 151*b* has six size adjustment nut flats 155. Four mounting screws 251 have mounting screw threads 253 sized to engage ski sliding device mounting holes 9*a*, 9*b*, 9*c*, 9*d*. Mounting screws 251 have a mounting screw head 255 and a mounting screw tool interface 257. Stainless steel is the preferred material for these fasteners.

Boot

A boot 601 is comprised of a boot sole 615. Boot sole 615 is comprised of a boot heel sole 603 and a boot toe sole 605. Boot heel sole 603 has a boot heel lip 607 and a boot heel support zone 611. Boot toe sole 605 has a boot toe lip 609 and a boot toe support zone 613.

Overall Assembly

1. Resilient Layer 101 is placed onto ski sliding device 3 so that resilient layer screw holes 103*a*, 103*b*, 103*c*, 103*d* are aligned with ski sliding device mounting holes 9*a*, 9*b*, 9*c*, 9*d*.
2. Both size adjustment nuts 151*a*, 151*b* are then placed in resilient layer notches 107*a*, 107*b*.
3. Platform 201 is placed on top of resilient layer 101 and size adjustment nuts 151*a*, 151*b*. Mounting screws 251 are used to retain platform 201 and resilient layer 101 to ski sliding device 3 by inserting them through platform screw holes 203*a*, 203*b*, 203*c*, 203*d* and resilient layer screw holes 103*a*, 103*b*, 103*c*, 103*d* and securing them into ski sliding device mounting holes 9*a*, 9*b*, 9*c*, 9*d*.
4. Either the first fixed bail assembly or first fixed heel bail 301 and first fixed heel block 401, FIG. 1, second fixed bail assembly or second fixed heel block 481 and second fixed heel bail 371, FIG. 8, or rotary bail assembly or rotary block 421 and rotary heel bail 351, FIG. 7, is attached to platform 201 on platform frictionalized surface 209*a* via inserting size adjustment screw 501*a* into size adjustment nut 151*a*. When grooves on the respective blocks are mated properly with the respective grooves on the platform 201, size adjustment screw 501*a* can be tightened with the appropriate tool thereby affixing the block and bail to the platform.
5. The toe lever assembly or rotary block 421, toe bail 331 and lever 451 can be screwed to platform 201 on platform frictionlized surface 209*b* in a similar fashion.

Description of Operation

The rounded section of the heel bail (303, 353, or 373) is placed in boot heel lip 607. Lever scallop 463 and lever second rounded end are placed on boot toe lip 607, and, if adjusted properly to the boot size, lever 451 is pivoted past a dead center position toward boot 601, FIG. 2. Lever adjustment screw 471 is then turned to ensure boot 601 is under sufficient tension. If the boot size adjustment were wrong, one would merely loosen a size adjustment screw 501*a*, 501*b* and move the appropriate block-bail assembly to a new position, then re-tighten a size adjustment screw 501*a*, 501*b*. During this operation of boot size adjustment, note that no fasteners are removed from the binding. Rather, this design only requires loosening and tightening of fasteners. Due to this fact, neither toe bail 331 nor the heel bail 301 being used become separated from the binding.

The user wears a boot 601 on each leg. Then, a ski sliding device and binding are attached to each boot, and the user can slide on snow for recreation, competition, or exercise. As ski sliding device 3 flexes due to turning and terrain, resilient layer 101 compresses, thereby allowing ski sliding device 3 to flex more freely than if platform 201 were mounted directly to ski sliding device 3. Furthermore, because platform 201 is substantially rigid, it's central mount is important to allowing for uninhibited flex of ski sliding device 3.

First fixed heel bail 301 and second fixed heel bail 371 are able to function as slight torsion springs against boot heel lip 607 if the are appropriately sized. This is primarily due to the fact that the are prevented from rotating, unlike rotary heel bail 351.

Second Embodiment

General

Figure 10:
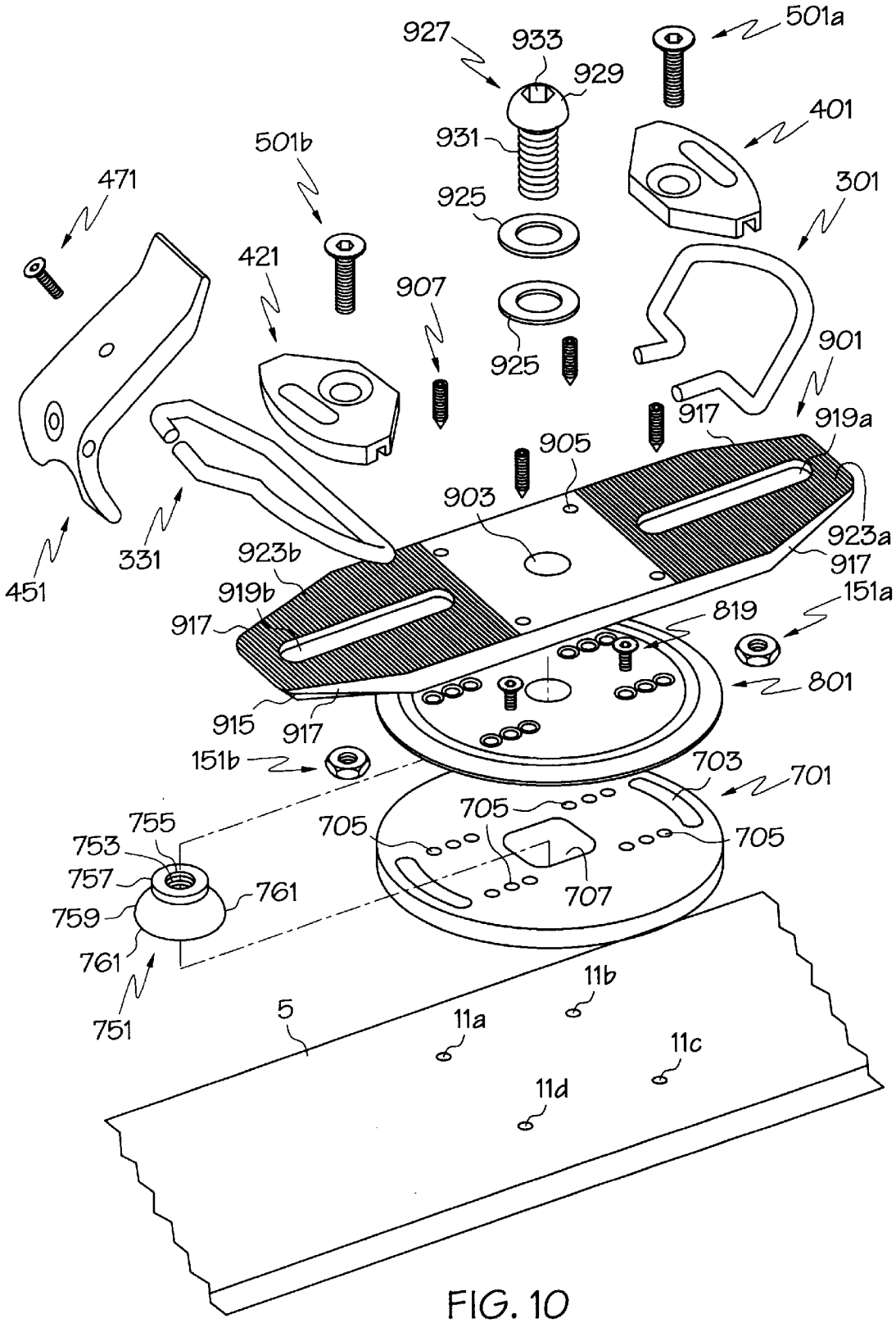
FIG. 10 shows an exploded view of a second embodiment of a boot binding and snowboard sliding device
Figure 11A:
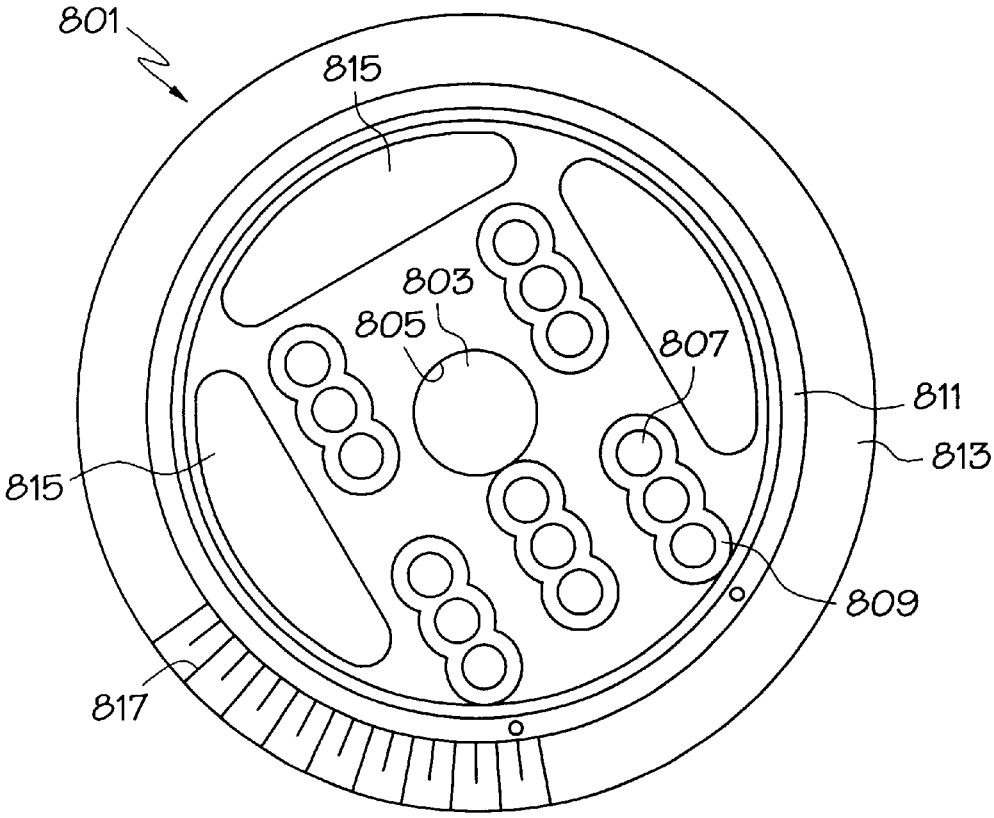
FIG. 11*a* shows a top view of a retaining layer.
Figure 11B:
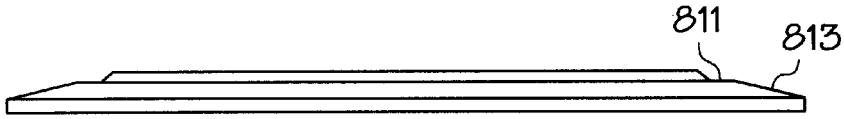
FIG. 11*b* shows a side view of a retaining layer.

FIG. 10 shows a snowboard sliding device 5 with a snowboard sliding device mounting hole 11*a*, 11*b*, 11*c*, 11*d*. Snowboard sliding device mounting holes 11*a*, 11*b*, 11*c*, 11*d* often contain 6 mm diameter×1 mm pitch stainless steel threaded inserts of the type commonly used in the snowboard industry. While four snowboard sliding device mounting holes 11*a*, 11*b*, 11*c*, 11*d* are depicted in FIG. 10 and are the preferred number, fewer or more mounting holes will suffice.

Figure 14:
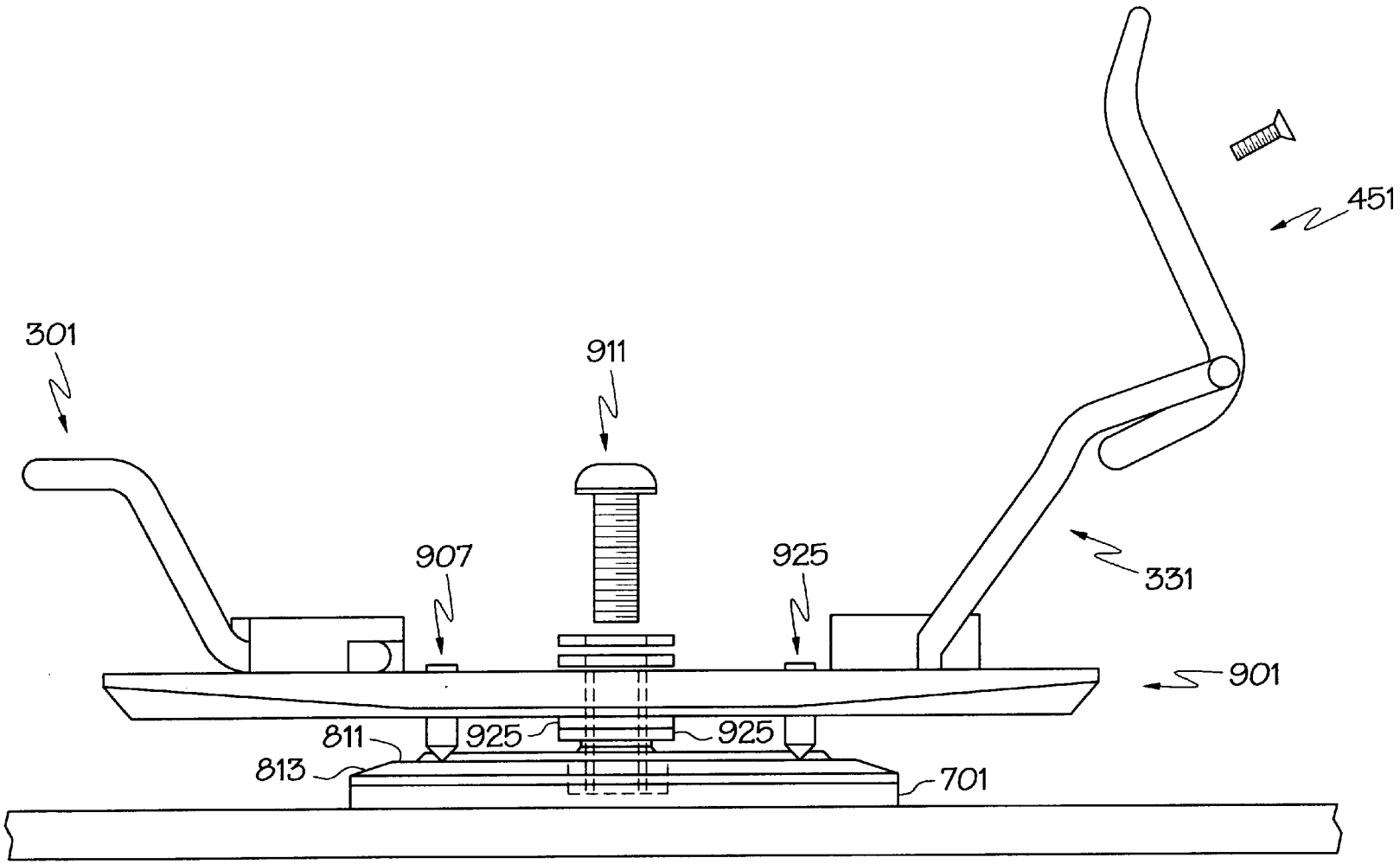
FIG. 14 shows a side view of a second embodiment of a boot binding and snowboard sliding device.
Figure 15:
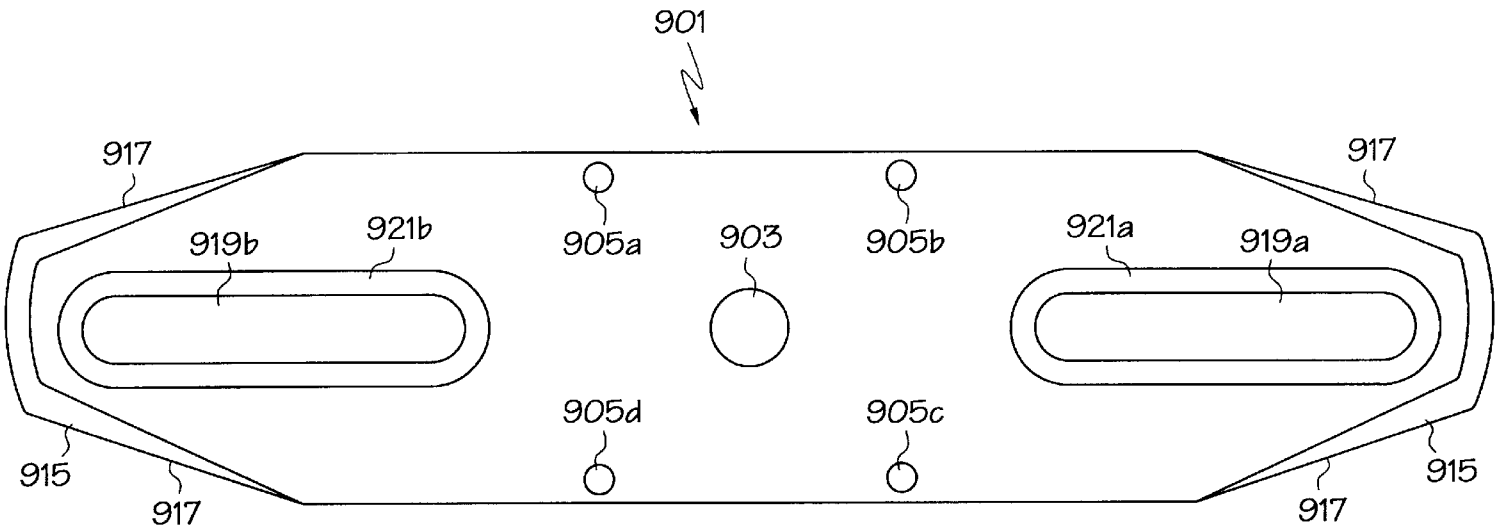
FIG. 15 shows an underside view of a tilt platform.

As shown in FIGS. 10 and 14, a retaining layer 801 mounts to snowboard sliding device 5. A resilient disc layer 701 rests between snowboard sliding device 5 and retaining layer 801. A tilt platform 901 is joined to retaining layer 801 by a central fastener 927 and a spherical nut 751. A fixed heel block 401 is joined to tilt platform 901 and holds secure a first fixed heel bail 301 which in turn holds secure a boot heel lip 607 (not shown).

Similarly, a rotary block 421 is joined to tilt platform 901 and holds secure a toe bail 331. A lever 451 is also attached to toe bail 331 and is used to secure boot toe lip 609 (not shown).

In the second embodiment lever 451 is used to clamp boot toe lip 609 and a heel bail, specifically referred to as a first fixed heel bail 301, a rotary heel bail 351, or a second fixed heel bail 371, is used to clamp boot heel lip 607. It should be noted that with slight modifications lever 451 could be used to clamp boot heel lip 607. Similarly, with slight modification first fixed heel bail 301, rotary heel bail 351, or second fixed heel bail 371 could be used to clamp boot toe lip 609.

Said second embodiment has many features similar to said first embodiment. To prevent duplication of efforts, elements with dual use which have previously been discussed in said first embodiment will be partially or fully eliminated. It should also be noted that element materials and fabrication methods also remain the same.

Resilient Disc Layer

A resilient disc layer 701, FIG. 10, is used to isolate retaining layer 801 from contacting snowboard sliding device 5. Resilient disc layer 701 has a resilient disc layer mounting screw hole 705 to facilitate a resilient disc layer mounting screw 819. Resilient disc layer 701 may also contain a resilient disc layer hollow 703 to reduce weight. A resilient disc layer non-circular aperture 707 is provided at the approximate center of resilient disc layer 701. Resilient disc layer non-circular aperture 707 is sized to approximately mate with a spherical nut non spherical zone 761. Approximate diameters of a resilient disc layer 701 range from 100 mm to 150 mm, the optimum being near 125 mm. Suitable durometer measurements range from 50–90 durometer. Optimal durometer is 60–80.

Central Fastener, Spherical Nut, and Annular Spacers

Tilt platform 901 is attached to a snowboard sliding device 5 by a tilt platform central fastener 927. Tilt platform central fastener 927 has a tilt platform central fastener thread 931 and a tilt platform central fastener head 929. Tilt platform central fastener head 929 has a tilt platform central fastener tool interface 933. Tilt platform central fastener 927 engages a spherical nut 751. Spherical nut 751 contains a spherical nut hollow 753 with spherical nut internal threads 755. The top of spherical nut 751 forms a spherical nut shoulder 757. Joined to spherical nut shoulder 757 is a spherical nut spherical surface 759. Spherical nut spherical surface 759 is bisected by a spherical nut non-spherical zone 761.

An annular spacer 925 is sized to fit tilt platform central fastener 927. Annular spacers 925 are positioned around tilt platform central fastener 927 either between spherical nut shoulder 757 and tilt platform 901 or between tilt platform 901 and tilt platform central fastener head 929 or a combination thereof.

Preferred materials for these parts is stainless steel, although many other materials would suffice.

Retaining Layer

Spherical nut 751 is retained to snowboard sliding device 5 by a retaining layer 801. As shown in FIG. 10, 11*a*, 11*b*, and 14 retaining layer 801 has at least one retaining layer central aperture 803 to facilitate tilt platform central fastener 927 and spherical nut shoulder 757 passing through. Retaining layer central aperture 803 has a retaining layer spherical counter bore 805 on it's underside. Retaining layer spherical counter bore 805 is sized to mate with spherical nut spherical surface 759. Retaining layer spherical counter bore 805 and spherical nut spherical surface 759 provide for a ball and socket type joint. Retaining layer mounting holes 807 are provided in retaining layer 801 to facilitate attachment to snowboard sliding device 5. Each of the retaining layer mounting holes 807 has a retaining layer mounting hole counter bore 809 on the upward side of retaining layer 801. The position of retaining layer mounting holes 807 may match with existing industry standards. By replicating retaining layer mounting holes 807 at select positions in retaining layer 801 certain mounting positions for retaining layer 801 may be attained. Retaining layer mounting holes 807 are surrounded by a retaining layer annular zone 811. A retaining layer chamfer 813 is provided for clearance of tilt platform 901. Retaining layer apertures 815 are provided in locations where strength is not critical. Retaining layer angle markings 817 are provided on retaining layer chamfer 813. A general range for retaining layer 801 diameters is 100 mm to 150 mm, with the optimum being about 125 mm. Although retaining layer 801 could be manufactured from many suitable materials, a recommended material is 7075 T6 aluminum.

Figure 17B:
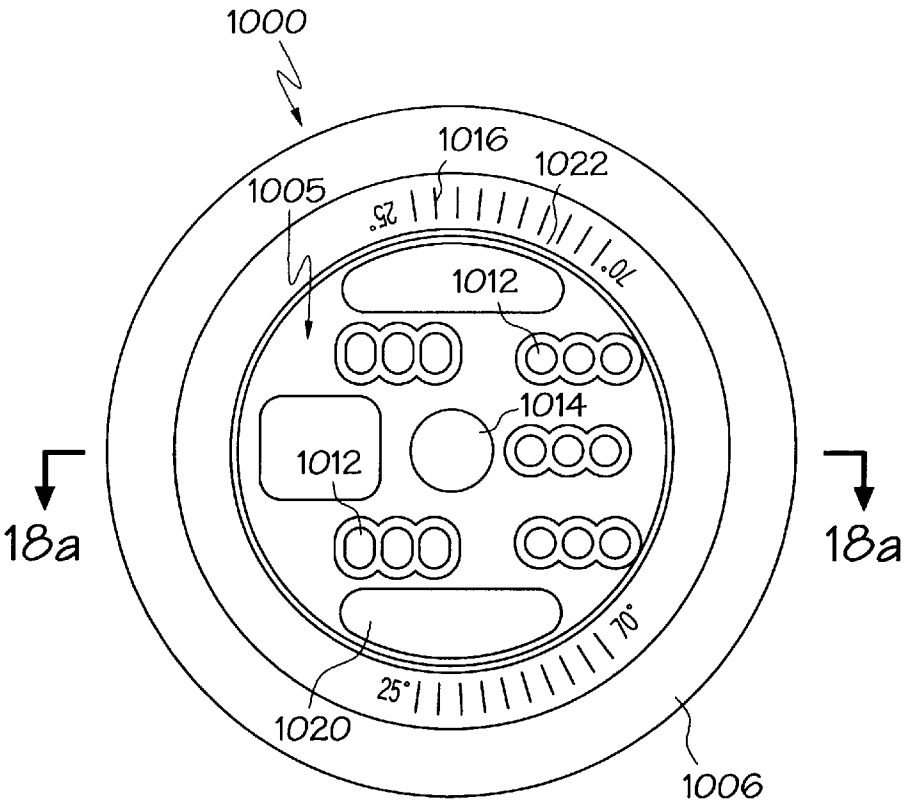
FIG. 17*b* shows a top view of an embodiment of the retaining layer.
Figure 18A:
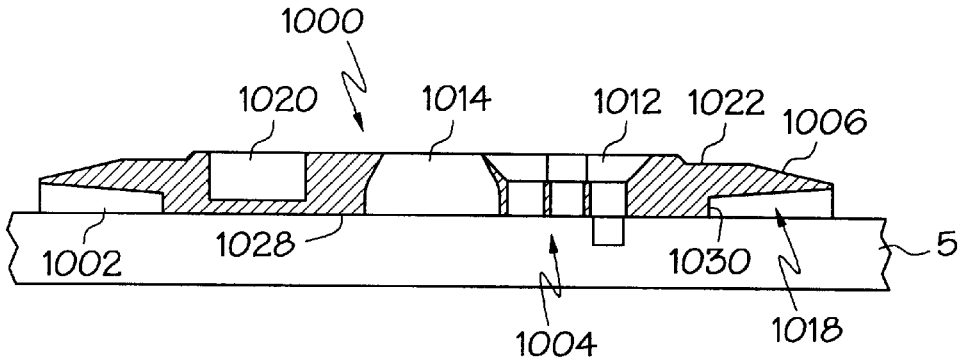
FIG. 18*a* shows a cross section A—A of FIG. 17*b*.
Figure 18B:
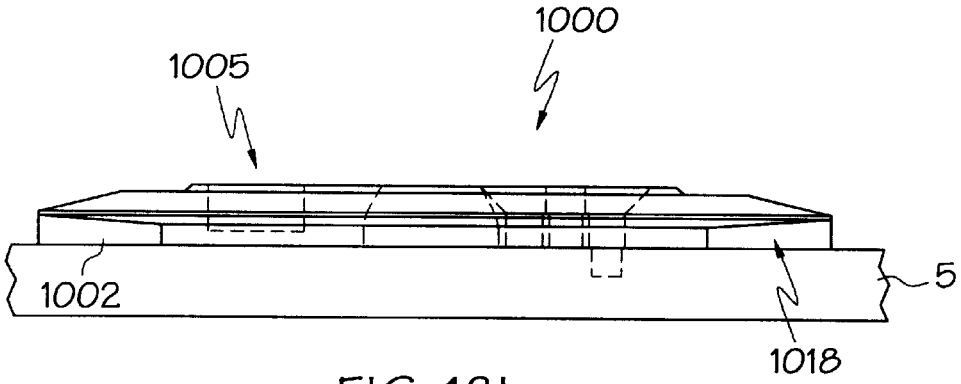
FIG. 18*b* shows a side view of the embodiment in FIG. 17*b*.

Another embodiment of a retaining layer 1000 is shown in FIG. 17*b*, 18*a* and 18*b*. The retaining layer 1000 has a central mount 1014 for attachment with a platform 901. A number of attachment holes 1012 are provided in the top surface 1005 for attaching the retaining layer 1000 to a snowboard sliding device 5 (not shown). Various pockets and 1020 can be provided in the retaining layer 1000 for weight reduction of the piece. The retaining layer 1000 also has an exterior angled ledge 1006, best shown in FIG. 18*a*, on the top surface 1005 and an exterior annular recess 1018, on the bottom surface 1004. FIG. 18*a* flat base 1028 is also shown on the bottom surface 1004 with a step 1030 providing the transition between the flat base 1028 and the annular recess 1002. A central mount 1014 is shown to provide for attachment of the retaining layer 1000 to the platform 901.

A concentric set screw zone 1022 is interior the ledge 1006 and can have angle marking s1016 or other indicia for aiding in the setup and adjustment of the binding, FIG. 17*b*.

Figure 17A:
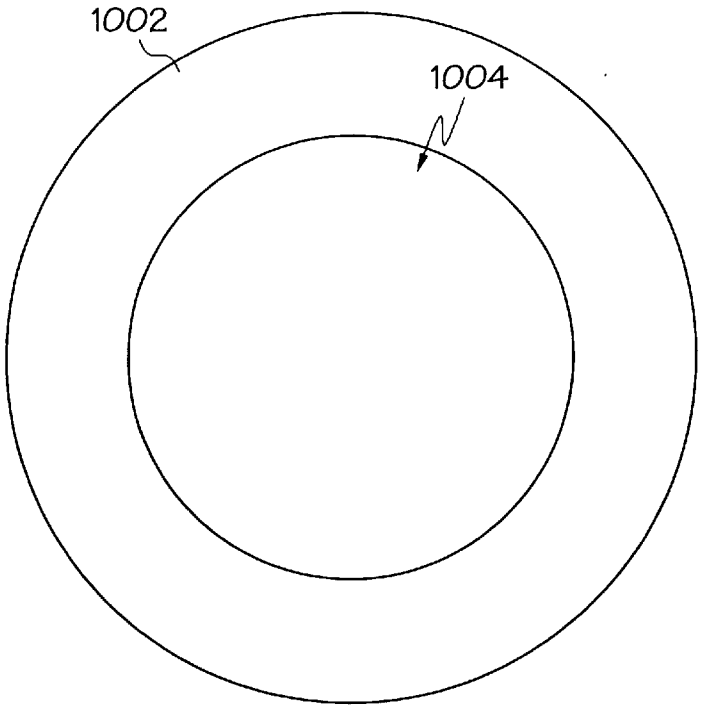
FIG. 17*a* shows a top view of an alternative resilient layer which is annular in shape without any through holes.

FIG. 17*a* shows an alternate resilient layer 1002 which has an aperture 1004 in the central region thereby giving alternate resilient layer 1002 an annular shape. Approximate diameters of alternate resilient layer 1002 range from 125 mm to 175 mm, the optimum being near 150 mm. Similarly, approximate diameters of aperture 1004 range from 80 mm to 150 mm, the optimum being near 100 mm. Suitable durometer measurements range from 50–90 durometer. Optimal durometer is 60–80. The dimensions of alternate resilient layer 1002 are sizes to fit the exterior annular recess 1018 of retaining layer 1000.

Figure 19:
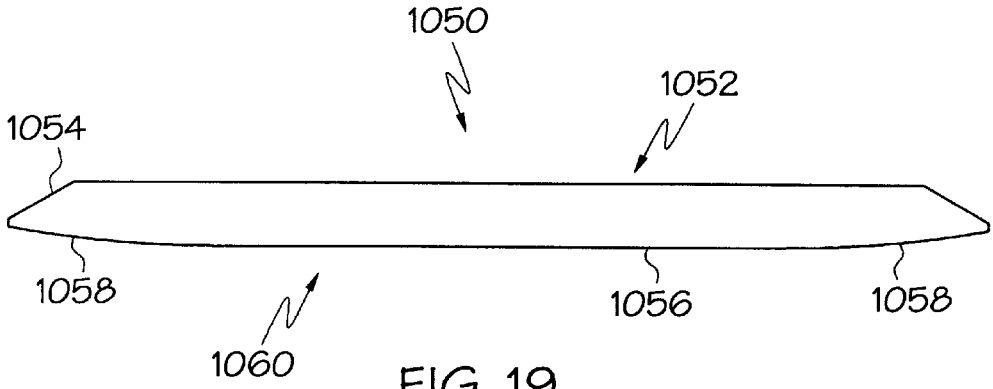
FIG. 19 shows a profile of another embodiment of a retaining layer having a flat mounting base transitioning to a curved face on the bottom surface.

FIG. 19 shows a side view profile of another embodiment of a retaining layer 1050. This embodiment has a bottom surface 1060 with a substantially flat mounting base 1056 transitioning to a curved face 1058. The top surface 1052 is substantially flat having an annular chamfer 1054 at the outer edge.

Figure 20:
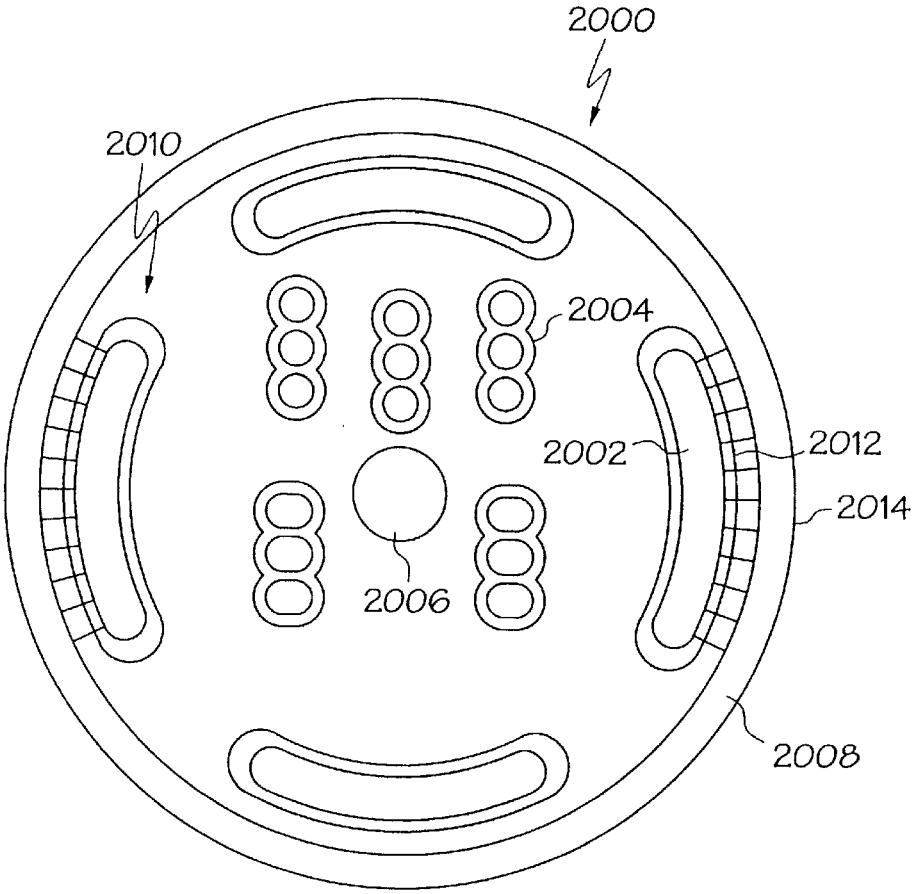
FIG. 20 shows a top view of another embodiment of a retaining layer.

FIG. 20 shows another embodiment of a retaining layer 2000. The retaining layer 2000 has a top surface 2010 with a central mount 2006 for affixing a platform 901 with a fastener.

A plurality of mount holes 2004 are provided to affix the retaining layer 2000 to the snowboard sliding device 5 (not shown). A plurality of arcuate slots 2002 are provided near an outer edge 2014. A plurality of zones 2012 are located near at least one of the arcuate slots 2002. This embodiment shows two zones 2012, but more or fewer could be provided.

Retaining Layer Mounting Screws

Figure 13:
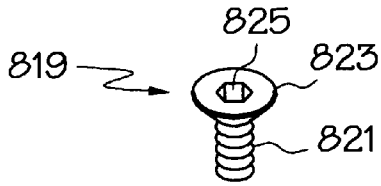
FIG. 13 shows a retaining layer mounting screw.

A retaining layer mounting screw 819 passes through retaining layer mounting holes 807 and resilient disc layer mounting screw hole 705. Retaining layer mounting screws 819, FIG. 13, have an retaining layer mounting screw external thread 821 sized to mate with snowboard sliding device mounting holes 11*a*, 11*b*, 11*c*, 11*d*. Retaining layer mounting screws 819 also have a retaining layer mounting screw head 823 sized to fit retaining layer mounting hole counter bore 809, FIG. 11*a*. Retaining layer mounting screw head 823 has a retaining layer mounting screw tool interface 825. Stainless steel is preferred.

Tilt Platform and Tilt Supports

Figure 16:
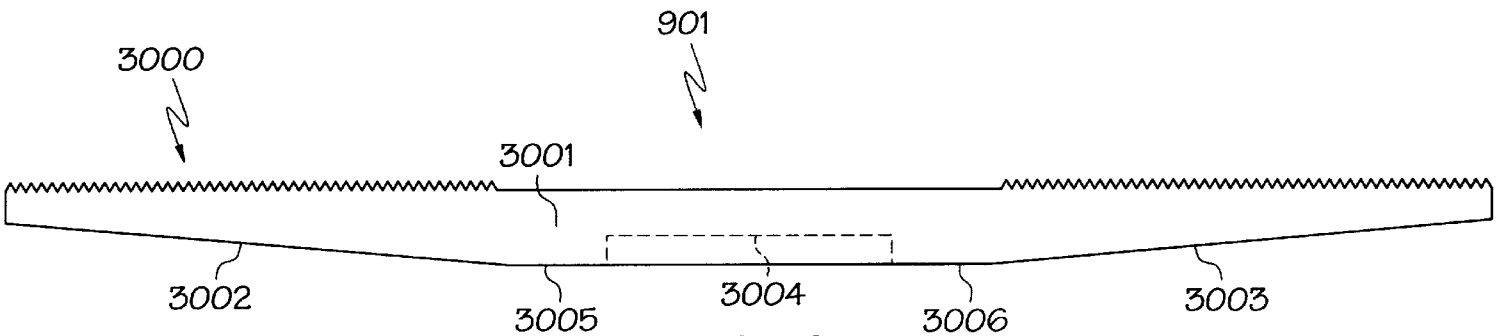
FIG. 16 illustrates a second embodiment of a means for minimizing the flat spots on a sliding device wherein a main binding plate having a minimal area for contact with the sliding device is shown.

Tilt platform 901 comprises a tilt platform central hole 903 and at least two tilt platform threaded holes 905. Platform 901 has a tilt platform taper shape 917. The platform 901 can also have a central sliding device contact zones 3005, 3006 which is at least 1/12 of the length of the platform 901, FIG. 16 but can vary between 1/12 and 1/3 of the length or possibly more. The perimeter of tilt platform 901 has a tilt platform chamfer 915 which varies in size. A tilt platform slot 919*a*, 919*b* exists as does a respective tilt platform counter slot 921*a*, 921*b*. Tilt platform 901 has a platform fictionalized surface 923*a*, 923*b* in the vicinity of platform slots 919*a*, 919*b*. Tilt platform fictionalized surface 923*a*, 923*b* is in the form of teeth or grooves which extend perpendicular to tilt platform slot 919*a*, 919*b*. Tilt platform 901 has an overall dimension range of about 180 mm×60 mm×6 mm to 270 mm×80 mm×12.6 mm. The optimum thickness is about 8 mm to 11 mm. While many materials will suffice, 7075-T6 aluminum offers high performance at manageable cost.

Figure 12:
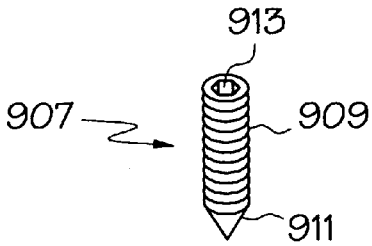
FIG. 12 shows a tilt support.

A tilt support 907, FIG. 12, has a tilt support thread 909 sized to mate with tilt platform threaded holes 905. Tilt support 907 has a tilt support cone point 911 designed to contact retaining layer annular zone 811. A tilt support tool interface 913 is provided on each tilt support 907 opposite tilt support cone point 911. Stainless steel 8 mm×1.25 mm pitch is recommended.

Figure 21:
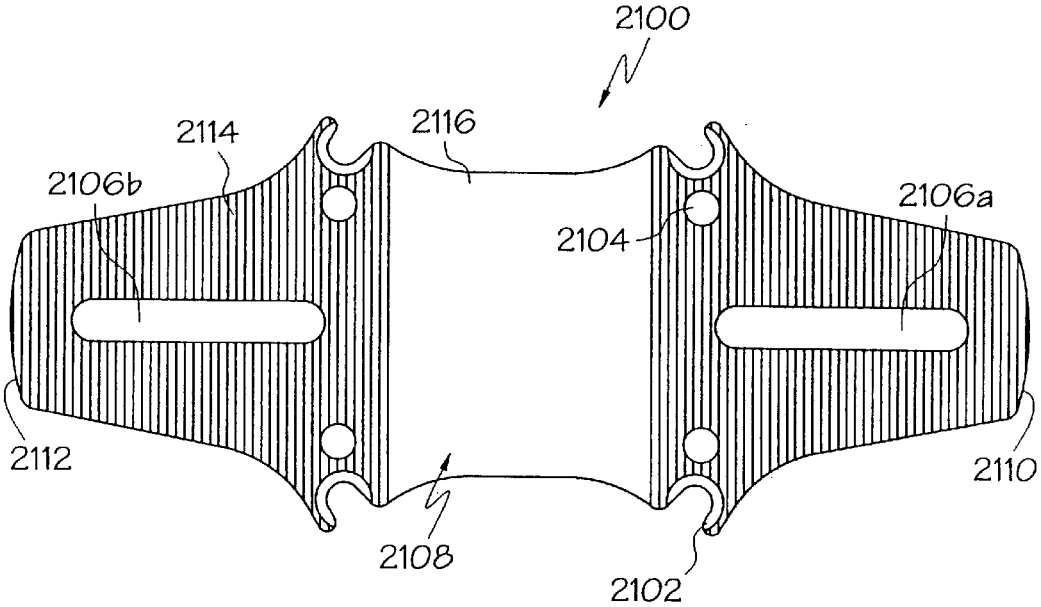
FIG. 21 shows a top view of another embodiment of a platform.

FIG. 21 shows another embodiment of a platform 2100. The platform 2100 has a top surface 2108 with first end 2110 and second end 2112. Slots 2106*a* and 2106*b* are located near the first end 2110 and second end 2112 respectively. A plurality of retainers 2102, this embodiment shows four, are located on the outer edges of the central zone 2116. The retainers 2102 are provided for fasteners (not shown) to affix the platform 2100 to, for example, retaining layer 2000.

A plurality of screw holes 2104, this embodiment shows four, are provided for tilt screws 907 which adjusts the angle of the platform 2100 relative to, for example, retaining layer 2000.

Overall Assembly

1. Resilient disc layer 701 is placed onto snowboard sliding device 5 so that resilient layer screw holes 705 are aligned with snowboard sliding device mounting holes 11*a*, 11*b*, 11*c*, 11*d*.
2. Spherical nut 751 is placed into resilient disc layer non circular apertures 707.
3. Retaining layer 801 is screwed onto a snowboard sliding device 5 thus retaining spherical nut 751.
4. Tilt supports 907 are screwed into tilt platform 901.
5. Tilt platform 901 is attached to spherical nut 751 via tilt support central fastener 927 and annular spacers 925. Tilt platform is now attached to the snowboard sliding device 5.
6. Either the first fixed bail assembly, second fixed bail assembly, or rotary bail assembly is attached to tilt platform 901 via inserting size adjustment screw 501*a* into size adjustment nut 151*a*. When frictionalized surface 923*a* is mated properly with the respective grooves on the heel block 401, size adjustment screw 501*a* can be tightened with the appropriate tool thereby securing the block 401 and bail 301 to the tilt platform 901.
7. The toe lever assembly, lever 451, toe bail 331 and rotary block 421 can be screwed to platform 901 in a similar fashion.
8. The binding is then sized to the boot.

Operation of Invention

Boot 601 is inserted into the binding as it was in the first embodiment.

Canting Adjustment

The boot binding is then adjusted to the appropriate stance angle and tilt. These adjustments can be made simultaneously. To adjust stance angle one loosens tilt platform central fastener 927 and rotates platform 901 to the desired angle relative to the snowboard sliding device 5.

To adjust the boot binding tilt one turns tilt supports 907 individually thereby changing the orientation plane of tilt platform 901. Each tilt support 907 must be adjusted so that each tilt support cone point 911 approximately contacts retaining layer annular zone 811. Additionally, each tilt support 907 must be adjusted so that when tilt platform central fastener 927 is tightened frictional forces are generated between each tilt support cone point 911 and retaining layer annular zone 811. These frictional forces must be sufficiently large to prevent tilt platform 901 from rotating when in use.

Additionally, such tightening produces static reactionary forces between the snowboard sliding device 5, retaining layer 801, and tilt platform 901 which increases rigidity and enhances performance.

Annular spacers 925 allow capability for a multitude of tilt positions with a single tilt platform central fastener 927. For low tilt angles both annular spacers 925 reside on tilt platform central fastener 927 between platform 901 and tilt platform central fastener head 929. Moderate tilt angles require one annular spacer 925 between tilt platform 901 and tilt platform central fastener head 929 and one annular spacer 925 between tilt platform 901 and spherical nut shoulder 757. Extreme tilt angles require both annular spacers 925 to reside between tilt platform 901 and spherical nut shoulder 757. Alternatively, the latter scenario enables a user to be elevated from the snowboard sliding device even at low tilt angles.

Stance Width Adjustment

Retaining layer 801 and resilient disc layer 701 are affixed to snow sliding device 5 by retaining layer mounting screws 819. Redundant retaining layer mounting holes 807 enable the boot binding position, or stance width, to be changed on snowboard sliding device 5.

Operation of disc

Analysis of the forces which act on retaining layer 801 shows a unique situation. A central force is exerted on retaining layer 801 in a direction approximately perpendicular to and away from a snowboard sliding device 5. The central force is exerted directly by a spherical nut, but ultimately is derived from the user and dynamics of the sport. Mounting screws 819 exert a force on the retaining layer 801 in a direction approximately perpendicular to and toward the snow sliding device. Since the position of mounting screws 819 generally surround the spherical nut 751 in close proximity, retaining layer 801 exhibits ample strength to retain a spherical nut 757. Tilt supports 907 exert a force on the retaining layer 801 approximately perpendicular to and toward snow sliding device 5. This force is applied in the annular zone 811 but is transmitted to the resilient layer 701 and snowboard sliding device 5 over a much larger surface area. Retaining layer 801 distributes the tilt support 907 point load over a large surface area. Hence, the snowboard sliding device 5 is evenly impacted, decreasing the likelihood of damage to a snowboard sliding device. This distributed force is counteracted by a reactionary force generated by the snow sliding device. The reactionary force is also transmitted through the resilient layer 701 to the retaining layer 801.

It should be noted that a retaining layer 701 too small (about 4 inches or less) will compress too much to offer a rigid interface.

Stance width adjustment is an operational quality generally regarded as being necessary for a boot binding as such. Stance width adjustment is implemented by multiple mounting apertures 807, FIG. 11*a*. Similarly stance angle adjustment is implemented by rotation of tilt platform 901 about the central fastener 927. Tilt adjustment is accomplished via tilt supports 907. Tilt supports 907 require a annular zone 811 on retaining layer 801. Because tilt supports 907 also rotate about the central fastener 927, said contact area is the annular zone 811. The annular zone 811 has a minimum diameter determined by the farthest extent of counter bore 807 from the central fastener 927. Hence the degree of stance width adjustment determines the farthest extent of annular zone 811. Industry standard mounting configurations and stance width options generally increase the extent of annular zone 811. Thus, for the tilt platform 901, tilt support binding to work, the annular zone 811, and hence the projection of substantially rigid material onto the snowboard sliding device 5, is large. Hence the resilient disc layer 701 counteracts this condition.

When in operation a sliding device 1 generally flexes. A component of the flexing is due to the terrain structure. Some of the flexing manifests itself in the form of unwanted vibrations. Resilient disc layer 701 operationally provides for vibration dampening. Additionally a resilient disc layer 701 or resilient layer 101 generally promotes flexing of a sliding device 1 or snow board sliding device 5 respectively. When in use the resilient disc layer 701 can compress to allow the sliding device 1 to flex more freely. In the absence of resilient disc layer 701, sliding device 1 would be contacted by a modified version of retaining layer 801, a substantially rigid member, or platform 201. Affixing a substantially rigid member directly to a sliding device 1 inhibits it's natural flex. However, this effect may be negligible if the size of the substantially rigid member were small when compared to flex amounts. As noted above, the preferred embodiment requires that a retaining layer 801 be large enough to allow for stance width adjustment and annular zone 811. Due to the large size of retaining layer 801 in the preferred embodiment, a resilient disc layer 701 greatly reduces disruptions to the natural free flex caused by a substantially rigid member.

What is claimed is:

1. A binding for attaching a boot to a snowboard, said binding comprising:

a retention means for attachment to said snowboard;

a support means for supporting said boot, said support means having a first end and second end with a central portion therebetween;

mounting means for attaching said support means to said retention means, said mounting means providing independent rotational and inclination adjustment of said support means with respect to said retention means, the inclination adjustment being continuous; and a first slot proximal to said first end and a second slot proximal to said second end, said first slot and said second slot each oriented approximately parallel to a longitudinal axis of said support means;

a first block positioned on said first end of said support means;

a second block positioned on said second end of said support means; and first and second retention means extending transversely through said first and second blocks and said first and second slots to affix said first and second blocks to said support means.

2. The binding of claim 1 further comprising:

positioning means for setting the longitudinal position of said first block and said second block relative to said support means.

3. The binding of claim 1 wherein said attachment means is comprised of at least one threaded fastener.

4. The binding of claim 2 wherein said positioning means comprises interlocking shapes.

5. The binding of claim 4 wherein said interlocking shapes comprise a plurality of grooves.

6. A binding for attaching a boot to a snowboard, said binding comprising:

a retention means for attachment to said snowboard;

a support means for supporting said boot, said support means having a first end and a second end with a central portion therebetween;

a mounting means for attaching said support means to said retention means, said mounting means providing independent rotational and inclination adjustment of said support means with respect to said retention means the inclination adjustment being continuous;

a block having a trough like cavity adjustably affixed to said support means; and a bail for affixing a boot sole to said support means, said trough like cavity retaining at least one portion of said bail to said support means.

7. The binding of claim 6 further comprising a plurality of at least three tilt supports affixed to said support means.

8. A binding for attaching a boot to a snowboard, said binding comprising:

a retaining layer for attachment to said snowboard;

a platform for supporting said boot having a first end and a second end with a central portion there between;

at least one fastener attaching said platform to said retaining layer, said fastener allowing independent rotational and inclination adjustment of said platform with respect to said retaining layer, the inclination adjustment being continuous; and a first slot proximal to said first end and a second slot proximal to said second end, said first slot and said second slot each oriented approximately parallel to a longitudinal axis of said platform;

a first block positioned on said first end of said support means;

a second block positioned on said second end of said support means; and first and second retention means extending transversely through said first and second blocks and said first and second slots to affix said first and second blocks to said support means.

9. The binding of claim 8 further comprising a plurality of at least three tilt supports affixed to said platform.

10. The binding of claim 8, further comprising:

positioning means for setting the longitudinal position of said first block and said second block relative to said support means.

11. The binding of claim 10 further comprising a plurality of at least three tilt supports affixed to said platform.

12. The binding of claim 8 wherein said retention means is comprised of at least one threaded fastener.

13. The binding of claim 10 wherein said positioning means comprises interlocking shapes.

14. The binding of claim 13 wherein said interlocking shapes comprise a plurality of grooves.

15. A binding for attaching a boot to a snowboard, said binding comprising:

a retaining layer for attachment to said snowboard;

a platform for supporting said boot having a first end and a second end with a central portion therebetween;

at least one fastener attaching said platform to said retaining layer, said fastener allowing independent rotational and inclination adjustment of said platform with respect to said retaining layer, the inclination adjustment being continuous;

a block having a trough like cavity adjustably affixed to said platform; and a bail for affixing a boot sole to said platform, said trough like cavity retaining at least one portion of said bail to said platform.

16. The binding of claim 15 further comprising a plurality of at least three tilt supports affixed to said platform.

17. The binding of claim 15 wherein said support means further comprises a first slot proximal to said first end; and a second slot proximal to said second end, said first slot and said second slot each oriented approximately parallel to a longitudinal axis of said support means.

18. A binding for attaching a boot to a snowboard, said binding comprising:

a retention means for attachment to said snowboard;

a support means for supporting said boot, said support means having a first end and a second end with a central portion therebetween;

a mounting means for attaching said support means to said retention means, said mounting means allowing independent rotational and inclination adjustment of said support means with respect to said retention means;

a block having a trough like cavity adjustably affixed to said support means;

a bail for affixing a boot sole to said support means; said trough like cavity retaining at least one portion of said bail to said support means; and a plurality of at least three tilt supports affixed to said support means.

19. A binding for attaching a boot to a snowboard, said binding comprising:

a retaining layer for attachment to said snowboard;

a platform for supporting said boot having a first end and a second end with a central portion therebetween;

at least one fastener attaching said platform to said retaining layer, said fastener allowing independent rotational and inclination adjustment of said platform with respect to said retaining layer;

a block having a trough like cavity adjustably affixed to said platform;

a bail for affixing a boot sole to said platform, said trough like cavity retaining at least one portion of said bail to said platform; and a plurality of at least three tilt supports affixed to said platform.

20. The binding of claim 19 wherein said support means further comprises a first slot proximal to said first end;

a second slot proximal to said second end;

said first slot and said second slot each oriented approximately parallel to a longitudinal axis of said support means.

21. A binding for attaching a boot to a snowboard, said binding comprising:

a retaining layer for attachment to said snowboard;

a platform for supporting said boot having a first end and a second end with a central portion therebetween;

at least one fastener attaching said platform to said retaining layer, said fastener allowing independent rotational and inclination adjustment of said platform with respect to said retaining layer;

a first slot proximal to said first end and a second slot proximal to said second end, said first slot and said second slot each oriented approximately parallel to a longitudinal axis of said platform; and a plurality of at least three tilt supports affixed to said platform.

22. The binding of claim 21 wherein said attachment means is comprised of at least one threaded fastener.

23. The binding of claim 21 wherein said distal means is comprised of interlocking shapes.

24. The binding of claim 21 wherein said interlocking shapes comprise a plurality of grooves.

25. A binding for attaching a boot to a sliding device comprising:

a retention plate comprising an upper first and lower second adjacent concentric disks, the first and second disks having respective first and second outer diameters and first and second heights; the outer diameter of the first disk being larger than the outer diameter of the second disk;

a resilient annulus concentric with the first and second disks having an inner diameter approximately equal to the outer diameter of the second disk, having an outer diameter approximately equal to the outer diameter of the first disk, and having a height approximately equal to the height of the second disk; and mounting apertures transversely oriented through the first and second disks of the retention plate.

26. The binding of claim 25 further comprising a taper formed in an underside of the upper first disk, the taper extending increasingly outward from a top portion of the resilient annulus as the radius of the first disk increases.

27. The binding of claim 25 further comprising a centralized bore formed in the first and second disks for housing boot support hardware.

28. The binding of claim 27 further comprising a boot support plate centrally mounted to the retention plate by the support hardware.

29. The binding of claim 28 wherein the boot support hardware comprises a universal joint for coupling the retention plate and boot support plate.

30. The binding of claim 28 wherein the boot support plate is spaced from the retention plate and further comprising:

a plurality of threaded bores formed in the boot support plate; and a plurality of set screws threaded in the bores and interfacing with an upper surface of the retention plate, for adjusting inclination of the boot support plate with respect to the retention plate.

31. The binding of claim 28 wherein the boot support plate is elongated along a longitudinal axis, and includes a first slot at a first end and a second slot at a second end, the first and second slots oriented parallel to the longitudinal axis of the boot support plate.

32. The binding of claim 31 further comprising first and second blocks, each block including an aperture for mounting the block to the boot support plate at the respective first and second slots via mounting hardware oriented transversely through the apertures and slots.

33. The binding of claim 32 wherein a portion of an under surface of the first and second blocks and a portion of an upper surface of the boot support plate include mating interlocking shapes for indexed positioning of the first and second blocks along the longitudinal axis.

34. The binding of claim 33 wherein the interlocking shapes comprise a plurality of grooves.

35. The binding of claim 25 wherein the resilient annulus comprises a flexible material.

* * * * *